US010193244B2

(12) United States Patent
Aboulkassem et al.

(10) Patent No.: US 10,193,244 B2
(45) Date of Patent: Jan. 29, 2019

(54) PUSH-IN CLAMP RETAINER, PUSH-IN CLAMP ASSEMBLY AND ELECTRIC CONNECTOR ELEMENT

(71) Applicant: TE Connectivity Germany GmbH, Bensheim (DE)

(72) Inventors: Mohamed Aboulkassem, Griesheim (DE); Christian Schrettlinger, Bensheim-Auerbach (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 15/204,298

(22) Filed: Jul. 7, 2016

(65) Prior Publication Data

US 2017/0012368 A1 Jan. 12, 2017

(30) Foreign Application Priority Data

Jul. 7, 2015 (EP) ..... 15175721

(51) Int. Cl.
*H01R 4/48* (2006.01)
*H01R 13/187* (2006.01)

(52) U.S. Cl.
CPC ..... *H01R 4/4836* (2013.01); *H01R 4/4845* (2013.01); *H01R 13/187* (2013.01)

(58) Field of Classification Search
CPC ... H01R 4/4818; H01R 4/4845; H01R 4/4809
USPC ..... 439/436–441, 834
See application file for complete search history.

(56) References Cited

U.S. PATENT DOCUMENTS 5,860,837 A 1/1999 Bock et al.
6,261,120 B1 * 7/2001 Beege ..... H01R 4/4836 439/268
6,336,824 B1 * 1/2002 Sorig ..... H01R 4/4836 439/395

(Continued)

FOREIGN PATENT DOCUMENTS

CN 1773775 A 5/2006
DE 23 49 614 A1 4/1975

(Continued)

OTHER PUBLICATIONS

DE102007035336B3_English translation Feb. 2009.*

(Continued)

*Primary Examiner* — Tulsidas C Patel
*Assistant Examiner* — Marcus Harcum
(74) *Attorney, Agent, or Firm* — Barley Snyder

(57) ABSTRACT

The invention relates to a push-in clamp retainer for an electric connector element with a lead wire receptacle which is at least partly encircled by a surrounding wall. In a lateral direction, a push-in clamp assembly includes such a push-in clamp retainer and a separate spring member having a first end and second end, The invention also relates to an electric connector element having a spring release member and a push-in clamp assembly. The invention involves the implementation of at least one receiving member into at least one contraction of the push-in clamp retainer, combining such a push-in clamp retainer with a spring member to form the push-in clamp assembly, and adding a spring release member to the push-in clamp assembly to obtain the electric connector element.

16 Claims, 13 Drawing Sheets

(56) References Cited

U.S. PATENT DOCUMENTS

| | | | | |
|---|---|---|---|---|
| 6,666,707 | B2 * | 12/2003 | Moret Codina | H01R 4/4845 200/51.09 |
| 6,796,855 | B2 * | 9/2004 | Fricke | H01R 4/4818 439/835 |
| 6,832,938 | B2 | 12/2004 | Lenker | |
| 7,544,103 | B2 | 6/2009 | Walter et al. | |
| 7,976,330 | B2 * | 7/2011 | Lin | H01R 4/4818 439/353 |
| 8,187,023 | B1 * | 5/2012 | Chen | H01R 4/22 439/439 |
| 8,251,738 | B2 * | 8/2012 | Heckert | H01R 4/4836 439/441 |
| 8,408,952 | B2 * | 4/2013 | Wu | H01R 4/4818 439/441 |
| 8,579,651 | B2 * | 11/2013 | Hanning | H01R 4/4836 439/441 |
| 8,851,920 | B2 * | 10/2014 | Wu | H01R 4/4827 439/441 |
| 2004/0248457 | A1 | 12/2004 | Walter | |
| 2007/0072481 | A1 * | 3/2007 | Edenharter | H01R 4/4818 439/441 |
| 2007/0099479 | A1 * | 5/2007 | Holterhoff | H01R 4/4836 439/441 |
| 2010/0081316 | A1 * | 4/2010 | Eppe | H01H 1/5844 439/441 |
| 2011/0207361 | A1 | 8/2011 | Heckert et al. | |

FOREIGN PATENT DOCUMENTS

| | | | | |
|---|---|---|---|---|
| DE | 202 11 513 | U1 | 1/2004 | |
| DE | 203 13 855 | U1 | 2/2005 | |
| DE | 20 2005 005 369 | U1 | 4/2006 | |
| DE | 10 2006 016 354 | A1 | 10/2007 | |
| DE | 102007035336 | B3 * | 2/2009 | H01R 4/4818 |
| DE | 196 14 977 | B4 | 11/2010 | |
| DE | 202011051516 | U1 | 2/2013 | |
| DE | 202014102270 | U1 | 5/2015 | |
| EP | 1353407 | B1 | 10/2003 | |
| EP | 1515397 | B1 | 2/2009 | |
| EP | 1429418 | B1 | 8/2009 | |
| EP | 2325947 | A1 | 5/2011 | |
| EP | 2768079 | A1 | 8/2014 | |
| EP | 2768047 | B1 | 5/2016 | |
| WO | 2014032979 | A1 | 3/2014 | |

OTHER PUBLICATIONS

European Search Report, dated Jan. 14, 2016, 9 pages.
Abstract of DE 2349614, dated Apr. 10, 1975, 1 page.
Abstract of DE 202 11 513, dated Nov. 27, 2003, 1 page.
European Patent Office Communication, dated Sep. 29, 2017, 9 pages.
Abstract of CN 1773775, dated May 17, 2006, 1 page.
Abstract of DE202014102270, dated May 18, 2015, 1 page.
Abstract pf EP2325947, dated May 25, 2011, 1 page.
Abstract of EP1515397 A1, related to EP1515397 B1, dated Mar. 16, 2005, 2 pages.
Abstract of WO2013050239, related to DE 20 2011 051 516, dated Apr. 11, 2013, 2 pages.
Abstract of EP2768079, dated Aug. 20, 2014, 1 page.
Abstract of WO 2014032979, dated Mar. 6, 2014, 2 pages.

* cited by examiner

PUSH-IN CLAMP RETAINER, PUSH-IN CLAMP ASSEMBLY AND ELECTRIC CONNECTOR ELEMENT

CROSS-REFERENCE TO RELATED APPLICATIONS

This application claims the benefit of the filing date under 35 U.S.C. § 119(a)-(d) of European Patent Application No. 15175721.8, filed Jul. 7, 2015.

FIELD OF THE INVENTION

The invention relates to a push-in clamp retainer for an electric connector with a lead wire receptacle which is at least partly encircled by a surrounding wall in a lateral direction. The invention further relates to a push-in clamp assembly comprising a push-in clamp retainer and a separate spring member comprising a first end and a second end. Finally, the invention relates to an electric connector element comprising a spring release member and a push-in clamp assembly.

BACKGROUND

Such push-in clamp retainers, push-in clamp assemblies or electric connector elements are known in the art and are often fabricated using injection molding which requires the insertion of an additional electrically conducting element into a lead wire receptacle in order to allow an electrical contact by pressing the lead wire against the electrically conducting element. Furthermore, push-in clamp assemblies are known in the prior art whereas riveting or welding is used to attach the spring member to the push-in clamp retainer. Moreover, electric connector elements known from the prior art do not allow to compress and hold a spring member in an assembly position without additional means as for instance a screwdriver.

An electric connector element using a spring member to press a lead wire against an electrically conducting element is, for instance, known from the European Patent Application EP 2 325 947 A1. The disclosed electric connector element uses a lever to release a spring member or to exert force on a spring member in order to move said spring member out of or into the lead wire receptacle. If contacting of the lead wire with the electrically conducing element is initiated, the time it takes until full pressure of the spring member is applied to the lead wire, thus pressing the lead wire against the electrically conducting element, solely depends on the speed the lever is moved from an assembly position to an operating position. When applied with high voltage and/or current, arcing may occur between the lead wire and the electrically conducting element. Furthermore, the lever demands for a specially designed push-in clamp retainer and may completely prevent operation of the electric connector element if failure occurs to the lever.

Another exemplary electric connector element is known from the European Patent EP 1 515 397 B1. Such an electric connector element uses a specially-designed spring member, wherein a first end of the spring member is fed through an opening in a second end of the spring member increasing the complexity of the spring member.

Another electric connector element is known from the European Patent Application EP 2 768 0479 A1 and utilizes a simple spring member but requires an additional electrically conducting element, for instance a conductor rail placed in the lead wire receptacle.

SUMMARY

In accordance with the present invention, a push-in clamp retainer comprises a surrounding wall in a lateral direction that forms at least one lateral contraction of the retainer. In the lateral contraction, a receiving member for fixing a spring member to the retainer is located.

In accordance with the present invention, a push-in clamp assembly comprises a spring member whose first end is attached to the push-in clamp retainer in the at least one lateral contraction, and whose second end is a free end extending elastically displaceable into the lead wire receptacle.

In accordance with the present invention, an electric connector comprises a spring release member and a push-in clamp assembly. The spring release member is movable from an assembly position to an operating position. When in the assembly position, the spring member is elastically deflected by the spring release member away from the lead wire receptacle. When in the operating position, the spring release member is moved away from the spring member.

FEATURES OF THE INVENTION

In a preferred embodiment, the push-in clamp retainer may be cuboid-shaped where one dimension (e.g., the length), is larger than the second dimension (e.g., the width). Nevertheless, it is possible that the push-in clamp retainer has a length and width which are exactly or approximately the same, having a squared or circular foot print.

The push-in clamp retainer may be open in a direction, preferably both directions, perpendicular to the lateral direction. In this configuration, it may comprise only the surrounding wall.

It is preferred that the contraction is located away from the edge of the push-in clamp retainer. The contraction may be centered or off-center regarding the length of the push-in clamp retainer, whereas the contraction is preferably perpendicular to the larger dimension of the push-in clamp retainer, which is preferably the length.

In another preferred embodiment, the contraction may be formed as a single hump structure that is the surrounding wall and comprises a convex section followed by a concave section and a second convex section in the contraction section. The centered convex section thus extends into the area surrounded by the surrounding wall. The centered convex section of the contraction section may be formed as a double-hump structure that is the convex section of the contraction is replaced by a sequence of the convex section, a concave section and a second convex section. In this embodiment, the convex-centered section pointing towards the outside region of the push-in clamp retainer may act as guiding element for the spring member inserted into the push-in clamp retainer. The contraction may preferably extend along the entire height of the push-in clamp retainer but may also extend only partially along the height of the push-in clamp retainer.

The push-in clamp retainer may be constructed as a stamped and bent metal sheet part. In this embodiment, a contraction results in an increased stiffness of the push-in clamp retainer. If the contraction is not embodied along the entire height of the retainer wall, the contraction may, for instance, reach to the half-height of the push-in clamp retainer while the other half of the retainer height, which may be the upper or the lower half, is embodied as a convex bulge section located above or below the contraction, extending to the outside of the push-in clamp retainer.

The contraction itself may preferably be post-treated. An anti-corrosion layer may be applied to the contraction section as bending stresses especially metallic surfaces. Furthermore, an anti-friction coating may be conceivable, which facilitates the insertion of the spring member. The above-mentioned coatings may be applied over the full area of the contraction or applied in a pattern which saves coating material.

Furthermore, a general treatment of the contraction surface facing towards the inside of the push-in clamp retainer is possible. This surface may be roughened or textured in order to increase the friction between the receiving member of the contraction and the spring member. Although the spring member is preferably not fixed by friction locking, the treatment may be used to counterbalance effects of construction tolerances such that the spring does not move or vibrate in the receiving member.

Another preferred embodiment of the invention comprises two opposing lateral contractions of the push-in clamp retainer with a receiving member located in each of the lateral contractions. Two opposing lateral contractions may provide symmetric attachment means for the spring member as well as a symmetric load transmission from the spring member to the push-in clamp retainer. The contraction lines of both opposing lateral contractions are the lines connecting all apex points on the concave contraction surface of each contraction. Those contraction lines are preferably oriented parallel to the height of the push-in clamp retainer as well as parallel to the insertion direction which is defined by the orientation of the lead wire receptacle. In case of a multi-hump structure of the contraction section, multiple contraction lines may be defined. The contraction lines of all lateral contractions are preferably parallel to each other which allows for application of a spring member with a basically flat and planar first end.

It is also possible that the push-in clamp retainer comprises two contractions with different strengths (i.e., a different extent of the concave region into the interior of the push-in clamp retainer). Such an embodiment may be applied if, for instance, one side wall of the push-in clamp retainer is constructed with a higher stiffness. This embodiment may be preferable in case of a stamped and bent metal sheet part which is characterized by a non-continuous surrounding wall. The edges of such a sheet metal part may be brought into proximity by bending the entire sheet metal and, if no further means for fixing the two edges of the sheet metal are present, a shearing motion between the sheet metal edges may occur. Depending on the position of the gap in the surrounding wall, an increased stiffness by a stronger contraction may be preferable on one side of the push-in clamp retainer or on the other side.

In another embodiment of the inventive push-in clamp retainer, the receiving member comprises at least one slit. This slit is preferably oriented parallel to the at least one contraction line and parallel to the insertion direction. Furthermore, it is preferable if the slit is located at a contraction line in order to avoid forces on the surrounding wall acting in a direction of the wall thickness. Such forces would introduce unwanted torsion and shear moments to the wall. The slit may be encircled by the surrounding wall, forming an opening which prevents the spring member from falling out of the slit. Nevertheless, a slit open to one side, preferably open towards the lead wire insertion side, may be preferred if other means of fixing the spring member are applied. In such an embodiment, the slit may act as a guiding element for the spring member as well as an element ensuring the load transmission from the spring member to the push-in clamp retainer. The opening of the slit on the insertion side may comprise chamfered edges, which are advantageous for a simplified insertion of the spring member into the push-in clamp retainer.

Furthermore, the slit may be of a conical shape (V-shape) that is a decreasing slit width when approaching the end of the slit in the insertion direction. A slit formed in such a way may be preferable to obtain an automatic clamping of the spring member simply by insertion of the spring member and a frictional engagement between the spring member and the inside walls of the slits.

Furthermore, the inside walls of the slit may comprise a texture, a blocking, or a latching structure and/or a functional coating in order to increase a frictional engagement, establishing a locking between the spring member and the push-in clamp retainer or decreasing the friction between the spring member and the slit in order to ease the insertion of the spring member.

The inventive push-in clamp retainer may have at least one lateral contraction section which comprises a locking member for insertion of at least one counter-locking member of the spring member. The locking member may be embodied as a locking latch that extends into the interior of the push-in clamp retainer such that it may lock with a counter-locking latch of the spring member. The locking member may also be a circular or rectangular recess or opening surrounded by the retainer wall. The counter-locking member of the spring member may be a protrusion of the spring member pointing towards the surrounding wall. Furthermore, the locking member may be part of the slit located in the contraction section. The locking member may be a barrel-shaped distortion at the distal end of the slit or may be constructed as a contraction in the slit width. The locking member may, for instance, be at least one hump on the inner slit wall which may generally be located anywhere along the slit length. The solution with the barrel-shaped distortion may be locked with a spring member by means of regions of the side wall of the spring member with locally increased thickness. If a protrusion is located on the inner slit wall, the spring member may comprise an accordingly embodied recess in its side walls.

In another preferred embodiment, the push-in clamp retainer is a monolithically stamped and bent part made from sheet metal with two opposing edges of the sheet metal being engaged to one another by a positive lock to prevent a shearing motion of the edges. Stamped and bent parts made from sheet metal may be produced at high rates and low costs. However, forming a surrounding wall with such a stamped and bent part made from sheet metal, the surrounding wall may suffer from a possible movement and/or shearing motion of the edges against each other. Such a shearing motion may be prevented by at least one locking member, which may be comprised at one edge of the sheet metal. Said locking member may be constructed for insertion into a recess at the other edge of the sheet metal. Furthermore, a locking latch or a detent hook, used as locking member, are also conceivable. By such means, a movement of the two edges of the sheet metal against each other may be suppressed.

In another preferred embodiment of the inventive push-in clamp retainer, a further receptacle for retaining and fixing an electrically conducting element in the lead wire receptacle is provided. The further receptacle may be the lead wire receptacle or may be part of the lead wire receptacle or may at least partially line the lead wire receptacle. The further receptacle may be at least partially formed by the surrounding wall of the push-in clamp retainer. The further receptacle may comprise slits in which an electrically conducting element may be inserted, retained and fixed. The push-in clamp retainer having the further receptacle may be a free standing latch that at least partially represents the further receptacle.

The electrically conducting element may be retained in the further receptacle from a direction in or against the insertion direction of the lead wire. Hence, the further receptacle may be created at the same side of the push-in clamp retainer as the lead wire receptacle or at the opposite side of the push-in clamp retainer. The slits of the further receptacle may thus end in the upper edge of the surrounding wall or in the lower edge of the surrounding wall.

The electrically conducting element may be fixed in the further receptacle by means of a frictional engagement between the inner wall of the slits, parts of the inner wall of the push-in clamp retainer, and the inner wall of the latch in the further receptacle.

The electrically conducting element may further be fixed to the push-in clamp retainer by means of a locking and a counter locking element. The electrically conducting element may include the locking or counter locking element and the latch partially forming the further receptacle may include the counter locking element or the locking element.

The locking element may be a detent hook having a slanted and a steep surface. The slanted surface may facilitate insertion of the electrically conducting element into the further receptacle as the slanted surface may initiate a deflection of the latch of the further receptacle.

The counter locking element may be a recess inside or at the edges of the latch of the further receptacle. When positioned at the edges of the latch, the at least one recess opens towards the slits of the further receptacle. Upon sufficient insertion of the electrically conducting element into the further receptacle, the latch of the further receptacle may be deflected away from the further receptacle until the steep surface of the locking element reaches the counter locking member. The counter locking element may retain the locking element by at least partially wrapping around the locking element and the counter locking element may block the removal of the electrically conducting element out of the further receptacle by means of the steep surface of the locking element which abuts against an inner wall of the counter locking element.

The locking and counter locking element may abut against each other in the center of the latch of the further receptacle or at the edges of said latch.

The electrically conducting element may comprise at least one shoulder that delimits the insertion of the electrically conducting element. This shoulder or shoulders may touch the end of the slit or slits that at least partially form the further receptacle.

Contact of the end of the slit or slits with the at least one shoulder of the electrically conducting element is preferentially established after the locking element is engaged with the counter locking element. The electrically conducting element may be inserted into the further receptacle so far that in its final, fixed position it is flush with the upper edge of the push-in clamp retainer. The edge of the latch of the further receptacle and the edge of the eclectically conducting element which, during insertion of the electrically conducting element into the further receptacle, point towards each other may be a chamfer. The chamfer embodied at the latch of the further receptacle may facilitate the insertion of the electrically conducting element, and with the chamfer of the edge of the electrically conducting element flush with the upper edge of the push-in clamp retainer may facilitate insertion of the lead wire into the lead wire receptacle. Especially in the assembled state parts of the electrically conducting element may extend out of the further receptacle into a direction opposite to the insertion direction of the electrically conducting element.

The chamfer of the latch of the further receptacle may especially facilitate insertion of the electrically conducting element if said electrically conducting element comprises at least one locking latch without a tilted surface.

As the locking element may comprise only steep edges, the chamfer of the latch of the further receptacle may facilitate deflection of the latch away from the further receptacle in order to reach the locked position, in which the locking element is retained in the counter locking element.

In a preferred embodiment of the invention, a push-in clamp assembly comprises a push-in clamp retainer and a separate spring member comprising a first end and a second end. The first end of the spring member is attached to the retainer in the at least one lateral contraction and the second end of the spring member is a free end extending elastically displaceable into the lead wire receptacle. The spring member may be removeably received and/or removeably attached to the push-in clamp retainer. This embodiment is advantageous for service or assembly of the spring member as this embodiment further allows for easy replacement of the spring member. The replacement may be performed by a spring member with a different spring constant increasing or decreasing the contact force between the spring member and a lead wire. In turn, the contact force between the lead wire and the electrically conducting element is altered as well.

The spring member may be inserted into the push-in clamp retainer spaced apart from the side wall of the push-in clamp retainer. The spring member may be attached in the center of the push-in clamp retainer as well, with fixation of the spring member to the push-in clamp retainer preferentially off-center. The spring member, either inserted centered or off-centered to the push-in clamp retainer, may lean against a side wall of the push-in clamp retainer. Touching the side wall of the push-in clamp retainer prevents the spring member from being bent in the wrong direction.

It may be preferable if the spring member does not touch the side wall of the push-in clamp retainer. The advantage of such an embodiment is that the spring member does not impede access to a rear hollow space separated from the lead wire receptacle by the lateral contraction. Access to the rear hollow space may be advantageous if different additional functionalities are incorporated into the push-in clamp assembly.

Different embodiments of the first end and second end of the spring member are conceivable. The first end of the spring member is attached and/or locked to the push-in clamp retainer in the at least one contraction and may comprise a counter-locking member to snap fit with the aforementioned locking member of the at least one lateral contraction. Furthermore, the first end of the spring member may be tapered such that introducing the spring member into the receiving member, (e.g., the slit), is facilitated. Such a tapered shape simplifies a correct centering and aligning of the spring member with respect to the push-in clamp retainer. The tip of the tapered section of the first end of the spring member may merge into the parallel edges of the spring member with those parallel edges guided and/or fixed in the receiving member of the contraction. The edges of the first side of the spring member may have at least one structure to establish the snap fit to the aforementioned locking member of the push-in clamp retainer. The edges may comprise a surface structure as well, in order to increase friction with the receiving member of the push-in clamp retainer.

In place of the friction-increasing structure, a functional coating to reduce friction between the edges of the spring member and the receiving member of the push-in clamp retainer may be provided as well. The spring member may be completely incorporated into the push-in clamp retainer. By this means, the spring member may be mechanically protected against being touched by accident from outside the push-in clamp retainer.

If an easy disassembly of the spring member from the push-in clamp retainer is desired, the spring member may be preferably incorporated into the push-in clamp retainer. In this configuration, parts of the spring member may extend to the outside of the push-in clamp retainer allowing for access to the spring member and for a facilitated disassembly.

In another embodiment of the inventive push-in clamp assembly, the at least one lateral contraction receiving the spring member is a stopper for delimiting a deflection of the spring member away from the lead wire receptacle. If the second end of the spring member is elastically deflected away from the lead wire receptacle, the second end of the spring member may be tilted towards the contraction of the push-in clamp retainer.

The width of the push-in clamp retainer at the contraction may be smaller than the width of the second end of the spring member. Therefore, by further deflecting the second end of the spring member towards the contraction, the edges of the second end of the spring member may approach the at least one concave inner surface of the contraction. Upon sufficient tilting of the second end of the spring member, at least one edge of the second end of the spring member may touch the concave surface. This contact may stop the tilt of the second end of the spring member and the at least one contraction may act as a stopper for the spring member.

If the push-in clamp retainer comprises one contraction, the tilt of the second end of the spring member may not stop abruptly. After contact of the edge of the second end of the spring member with the concave inner surface of the contraction, the second end of the spring member is distorted around a longitudinal axis oriented along the second end of the spring member. This torsion is stopped when the force exerted by the lead wire to the second end of the spring member equals the counteracting torsion force exerted by the second end of the spring member.

The push-in clamp assembly may comprise two equally configured contractions. In this embodiment, both edges of the second end of the spring member may touch the concave inner surface of the two contractions at the same time if the second end of the spring member is tilted towards the contractions. In a preferred embodiment of the inventive push-in clamp assembly, the above-described function of a single stopper and two stoppers may be combined in one push-in clamp retainer. This may be established by usage of different strengths of the two comprised contractions. The contraction extending deeper into the inner area of the push-in clamp retainer may provide the functionality of a single stopper. Upon deflection away from the lead wire receptacle, the edge of the second end of the spring member may at first establish contact to the stronger contraction. This contact is followed by a torsion of the second end of the spring member around the aforementioned longitudinal axis, with the center of rotation located at the contact point of the edge of the second end of the spring member with the stronger contraction. This torsional movement may continue until the second edge of the second end of the spring member touches the second, weaker contraction of the push-in clamp retainer. The combination of the stronger contraction and the weaker contraction provides the functionality of two equally configured stoppers. Further deflection of the second end of the spring member is prevented after contact of the second end of the spring member with the second contraction.

The spring member may comprise an elasticity enhancement member. This elasticity enhancement member may be embodied as a bend in the spring member acting as an elastically deflectable area leading to a tilt of the pivot point of the second end of the spring member. Hence, the pivot point of the second end of the spring member is not fixed, but tilted around the elasticity enhancement member. To incorporate the functionality of an elasticity enhancement member, modifications of the material and/or shape of the spring member are also possible. The spring member may, for instance, comprise a region of different, softer material yielding a smaller spring constant. The shape of the spring member may also be altered in terms of its thickness and/or width leading to a changed spring constant as well. The region of the decreased spring constant represents the elasticity enhancement member.

In one embodiment of the inventive push-in clamp assembly it is preferred that the spring member comprises a bent section which extends over more than 270°. Due to such a bent section of the spring member, a loop of the spring member may be formed. This loop of the spring member may be preferentially located in the center of the spring member, however, it may also be slightly off-centered and may merge into the two ends of the spring member which may be equal in length or show different lengths. An angle larger than 270° is preferred, as the transmission of the force exerted to the second end of the spring member and transmitted to the first end of the spring member may be distributed in a non-punctual manner to the receiving member of the push-in clamp retainer.

In case of a straight spring member, (i.e., a cantilever), the force exerted onto the free end of the spring member would be transmitted to the receiving member via the first, fixed end of the spring member locally to the upper and lower contact points of the first end of the spring member and the receiving member. By means of a larger angle of the loop, the force exerted to the first end of the spring member may not solely be tangential any longer, but may be at least partly directed along the thickness of the spring member. The force exerted by the spring member may therefore be distributed over a larger contact area between the first end of the spring member and the inside wall of the receiving member.

In another preferred embodiment of the inventive push-in clamp assembly, the push-in clamp retainer has at least one recess in the lateral contraction, with the spring member extending at least partly into this recess. Such a recess has different advantages. Firstly, the material needed for production of the push-in clamp retainer may be reduced and secondly, the recess may allow for access to the interior area of the push-in clamp retainer. Furthermore. it may allow for easy incorporation of the spring member mainly inside the push-in clamp retainer without the need of a special construction of the spring member. Hence, the spring member may be flush with the upper edge of the surrounding wall of the retainer still allowing for access to the spring member. The surrounding wall may comprise two opposing recesses. These recesses may be of any height provided that the remaining material of the contraction conforms to stability needs of the push-in clamp retainer.

The at least one recess is preferably located around the contraction line. Consequently the fixation point of the spring member and especially the point of contact of the spring force may be moved to the center of the push-in clamp assembly. Hence, the spring force transmitted from the spring member to the push-in clamp retainer may be uniformly distributed in the push-in clamp retainer. The at least one recess in the lateral contraction furthermore may provide the opportunity to introduce a separate stopper or even a spring member blocking element which may completely prevent a deflection of the spring member and thus also prevent the insertion of a lead wire.

Furthermore, the recess in the lateral contraction may allow access to the spring member which may be compressed from the outside of the push-in clamp assembly. This may be performed, for instance, with a screwdriver in order to deflect the second end of the spring member away from the lead wire receptacle allowing for introduction of a lead wire without additional force exerted by the lead wire.

In another preferred embodiment of the inventive push-in clamp assembly, the spring member has at least one bend region such that the first end and the second end of the spring member span and angle smaller than 90°. The bend region of the spring member may be located in the center of the spring member or located off-center and is preferentially of a convex shape such that the first end of the spring member used for attaching the spring member to the contraction of the push-in clamp retainer merges into the bend region, which in turn merges into the second end of the spring member which extends toward and in the lead wire receptacle. The bend region of the spring member may be solely one convex shape but may be a sequence of multiple convex and concave shapes as well. The overall shape of the spring member, however, preferentially shows a convex progression.

As the first end and the second end of the spring member may span an angle smaller than 90° and as the first end of the spring member may be oriented parallel to the contraction line which is as well parallel to the insertion direction, the maximum angle between a lead wire inserted into the lead wire receptacle and the second end of the spring member amounts to 90°. The angle between the first end and the second end of the spring member is preferably smaller than 90°, which in turn results in an angle between the lead wire and the second end of the spring member also being smaller than 90°. Because of this angle, the lead wire may be inserted into the lead wire receptacle without getting stuck with the second end of the spring member. By choosing an angle between the first end and the second end of the spring member smaller than 90°, the second end of the spring member may extend into the lead wire receptacle, with the second end of the spring member preferably tilted downwards toward the contraction of the push-in clamp retainer.

In a preferred embodiment of the invention, the bend region of the spring member may touch the side wall of the push-in clamp retainer. By this means, the spring member is prevented from bending in the wrong direction, for instance, during removal of the lead wire.

Furthermore, an angle between the first end and the second end of the spring member smaller than 90° may facilitate the construction of the push-in clamp retainer. By this angle, the insertion direction of the spring member into the push-in clamp retainer may be largely parallel to the force exerted by a lead wire to the spring member. The locking mechanism holding the spring member in the locking member of the contraction of the push-in clamp retainer therefore may only provide a holding force to prevent the spring member from falling out of the push-in clamp retainer. Furthermore, an angle of 90° between the second end of the spring member and the lead wire secures the lead wire in the lead wire receptacle against unwanted removal when pulling the lead wire. If the lead wire is accidentally pulled into a direction opposite to the insertion direction, the second end of the spring member may get stuck with the lead wire. A frictional engagement is established between the second end of the spring member and the lead wire. Further pulling of the lead wire results in an even further increase of the frictional engagement due to the fact that this pulling movement compresses the spring member such that only a small fraction of the pulling force is transformed into a tangential force, rotating the second end of the spring member.

A larger fraction of the pulling force may be transformed into a force acting along the second end of the spring member, thus mainly deforming the convex bend region of the spring member. The counteracting force exerted by the spring member during insertion of a lead wire into the lead wire receptacle may therefore be smaller than the counteracting force exerted by the spring member during the pulling out of the lead wire. Thus, the angle between the first and the second end of the spring member smaller than 90° may have a securing function for the lead wire. Additionally, the combination of the lead wire receptacle side wall and the inclined second end of the spring member may act like a barbed hook.

In another preferred embodiment of the inventive push-in clamp assembly, the at least one lateral contraction separates the lead wire receptacle from a rear hollow space also partly encircled by the surrounding wall in the lateral direction. In this embodiment, the spring member extends at least partly into the rear hollow space. The design of the spring member may largely be independent on the form of the push-in clamp retainer. The spring member may extend into the rear hollow space which would not be possible if the spring member was attached to the wall of the push-in clamp retainer. Therefore, this preferred embodiment designing a bend region of the spring member having at least one convex spring member shape is conceivable as the convex spring member shape may extend into the rear hollow space. Furthermore, the diameter of the convex bend area of the spring member may be arbitrary as the bent spring member may reach out of the push-in clamp retainer.

The recess located in the contraction of the push-in clamp retainer allows to mainly incorporate the spring member into the push-in clamp retainer without the need of designing a region of the spring member with a smaller width in order to allow a tilt of the second end of the spring member without initial contact of the second end of the spring member with the stopper.

In another embodiment of the inventive push-in clamp assembly, the push-in clamp retainer preferably comprises a tongue extending into a loop of the spring member.

The tongue may extend from the surrounding wall away from the rear hollow space. The tongue may furthermore be bent towards the rear hollow space such that the bent tongue may extend into the bend region which forms a loop of the spring member.

The tongue is preferably bent by 90° and, hence, extending laterally into the loop of the spring member. The tongue may be constructed with a length sufficient to reach the opposite wall of the push-in clamp retainer and the opposite side of the push-in clamp retainer may comprise a recess for the tongue in order to form a stirrup between the opposing sides of the push-in clamp retainer. The tongue may represent a securing element against unwanted disassembly of the spring member from the push-in clamp retainer. The tongue may prevent the spring member from falling out of the push-in clamp retainer if the spring member is not fixed to a push-in clamp retainer by other means.

A preferred embodiment of the electric connector element comprises a push-in clamp assembly and a spring release member which is moveable from an assembly position to an operating position. When in the assembly position, the spring member is elastically deflected by the spring release member away from the lead wire receptacle. When in the operating position, the spring release member is moved away from the spring member. The spring release member may be loosely applied in the electric connector element, but may be secured against being lost by fixing it to the electric connector element as well. The spring release member may further be guided in the push-in clamp retainer by, for instance, guide grooves, sliding pins or slits.

The spring release member may be a rigid, hollow element having a hollow body, a bend region, and a tip. The spring release member may be further secured against rotation which leads to solely a linear movement into a direction parallel to or opposite to the lead wire insertion direction. The width of the spring release member may be as large as the push-in clamp retainer where the spring release member is installed. Hence, the push-in force exerted by the spring release member to the spring member may be distributed by a large surface and not punctually. The spring release member may be further designed such that it never extends into the lead wire receptacle, thus never influencing the operating and/or the assembly of the lead wire directly.

A different embodiment of the inventive electric connector element has a locking sub-assembly, with the spring release member configured to be locked in the assembly position by the locking sub-assembly. The locking sub-assembly may be formed as a latching arm monolithically attached to the spring release member, with the locking sub-assembly equipped with a detent hook. It is preferred that the latching arm is flexible with respect to the spring release member. The latching arm may be located on the same side as the arm having the spring release member, but may be located on the opposite side of the spring release member as well.

The push-in clamp retainer may comprise a counter-latching element which may be engaged with the locking sub-assembly by positive locking. In a further preferred embodiment of the electric connector element, the locking sub-assembly has an unlatching member, with a trigger surface manually operable from outside the electric connector element, operation of the trigger surface unlocking the locking sub-assembly. The unlatching member may be part of the push-in clamp retainer or may be embodied as a separate element.

The unlatching member may be a flexible element if it is part of the push-in clamp retainer, otherwise, (e.g., if the unlatching member is embodied as a separate element), the unlatching element may be movably incorporated into the push-in clamp retainer or may be, for instance, guided and kept in place by a guiding and/or fixing structure of the push-in clamp retainer. The guiding and/or fixing structure of the push-in clamp retainer may prevent loss of the unlatching member which otherwise may fall out of the push-in clamp retainer.

In another preferred embodiment of the electric connector element, the electric connector element is in a connector housing. The connector housing may encircle the electric connector element entirely or partly in a circumferential direction. Furthermore, the connector housing may cover the height of the electric connector element partly or entirely. The electric connector element may be inserted into the connector housing, such that no part of the electric connector element extends out of the connector housing.

The connector housing may furthermore comprise one, several, or all of the above-mentioned functional elements as for instance the counter-latching element. Also, the spring release member and/or the locking sub-assembly may be a flexible section of the connector housing.

Those functional elements may hence be embodied as a monolithical part of the connector housing, but they may also be separated from the connector housing and solely attached at or fixed to the connector housing. The connector housing of the electric connector element may be form-fit to the push-in clamp retainer. Therefore, if the push-in clamp retainer is a stamped and bent metal sheet part, the form-fit prevents a shearing motion of the push-in clamp retainer.

The connector retainer may furthermore comprise additional members for holding the push-in clamp retainer inside of the connector retainer. The holding means may be additional latching members designed to snap into or behind the edges or additional recesses of the push-in clamp retainer and keeping it in place in the connector retainer.

In another preferred embodiment, the connector retainer may provide connection means to establish an electric connection for instance by another clamp connection. The connector retainer may be another receptacle to receive the other clamp connection which may, for instance, be inserted into the connector retainer from a side opposite to the lead wire insertion side. The other clamp connection or parts of it may partly or fully extend into the lead wire receptacle.

All features of the above-described embodiments of the invention may be arbitrarily combined with each other. Several features may be added to the embodiments or removed from them as long as the functionality according to the invention is still given.

BRIEF DESCRIPTION OF THE DRAWINGS

For a more complete understanding of the present invention and the advantages thereof, preference is now made to the following detailed description. The description is taken in conjunction with the following figures in which some parts and/or functionalities are labeled with the same reference signs and each figure lists the differences to the preceding figures, not repeating already described features.

DETAILED DESCRIPTION OF THE EMBODIMENT(S)

Figure 1:
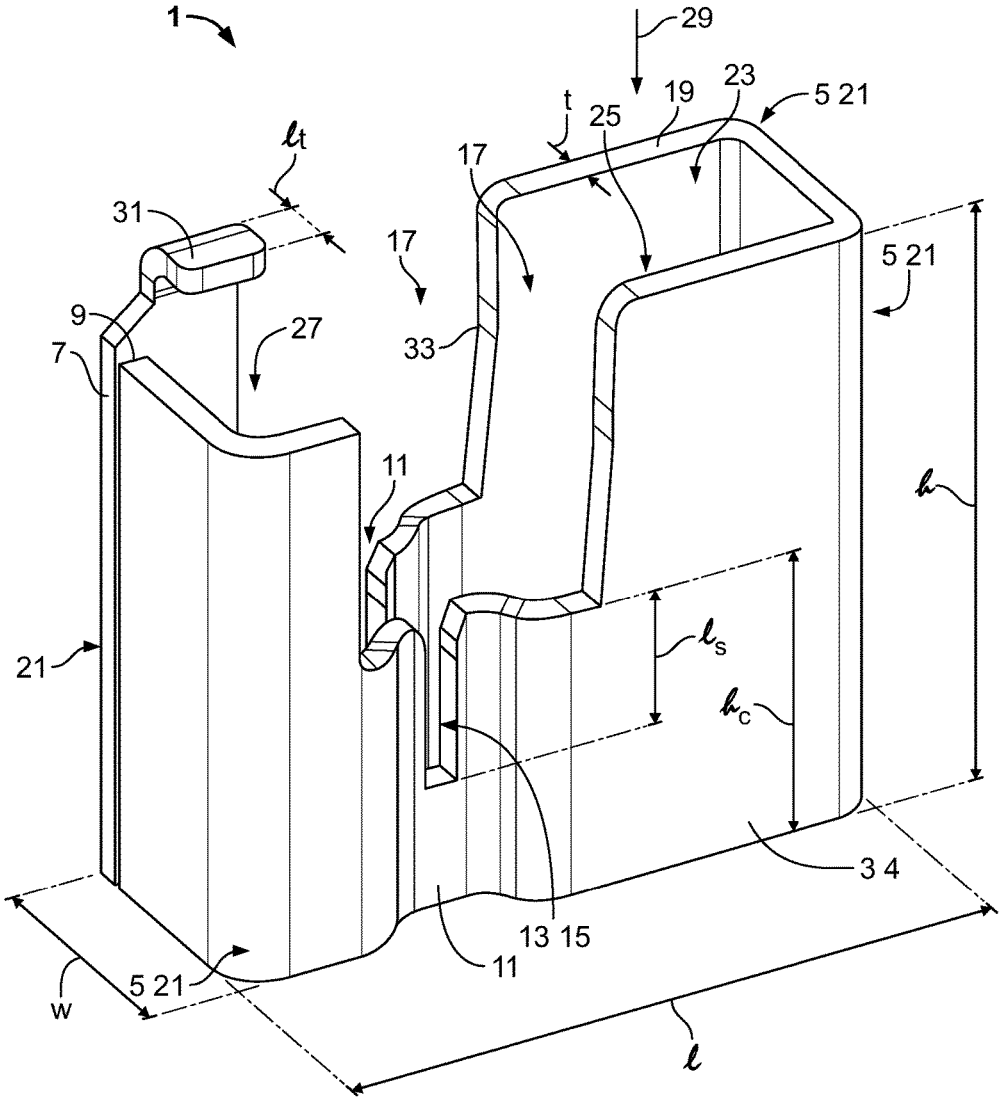
FIG. 1 is a perspective view of a first embodiment of a push-in clamp retainer.

FIG. 1 illustrates the first embodiment of the push-in clamp retainer 1. The push-in clamp retainer 1 is a bent and stamped sheet part comprising one sheet of metal 3 bent to form the surrounding wall 4 of the push-in clamp retainer 1. The push-in clamp retainer 1 is cuboid having a length 1, a width w, and a height h. The sheet metal 3, and hence the surrounding wall 4 as well, has a thickness t.

Due to the production process, the push-in clamp retainer 1 comprises rounded edges 5 and a first edge of the sheet metal 7 and a second edge of the sheet metal 9. The surrounding wall 4 is bent such that the first edge of the sheet metal 7 and the second edge of the sheet metal 9 are brought into proximity to each other. In this first embodiment of the push-in clamp retainer 1, the length 1 is larger than the width w, whereas the length 1 and the height h are similar.

The thickness of the sheet metal t is substantially constant over the entire surface of the push-in clamp retainer 1. Small deviations from the mean value of the thickness t of the sheet metal may occur in the bent regions of the push-in clamp retainer 1, as for instance in the rounded edges 5.

FIG. 1 further shows two opposing contractions 11 comprising two opposing receiving members 13 embodied as two opposing slits 15. Two opposing mirrored recesses 17 are shown in FIG. 1 as well. Those recesses 17 extend from the center of each of the contractions to the upper edge 19 of the push-in clamp retainer 1. The two opposing contractions 11 are parallel to the two opposing slits 15 as well as parallel to the four corner edges 21. One corner edge 21 comprises the first edge of the sheet metal 7 and the second edge of the sheet metal 9.

The length of the slit ls is approximately ¼ of the push-in clamp retainer height h, (i.e., half the height of the contractions hc). The opposing contractions 11 divide the inner part 23 of the push-in clamp retainer 1 into a lead wire receptacle 25 and a rear hollow space 27. The lead wire receptacle 25 defines an insertion direction 29 which is parallel to the corner edges 21, to the contractions 11, and to the slits 15.

FIG. 1 also shows a tongue 31, which is a monolithic part of the sheet metal 3 extending from the upper edge 19 away from the push-in clamp retainer 1 and which is bent by approximately 90° towards the inner part of the push-in clamp retainer 1. The tongue 31 is located at the rear wall 33 in proximity of the first edge of the sheet metal 7. The length of the tongue lt is smaller than half the width w of the push-in clamp retainer 1.

Figure 2:
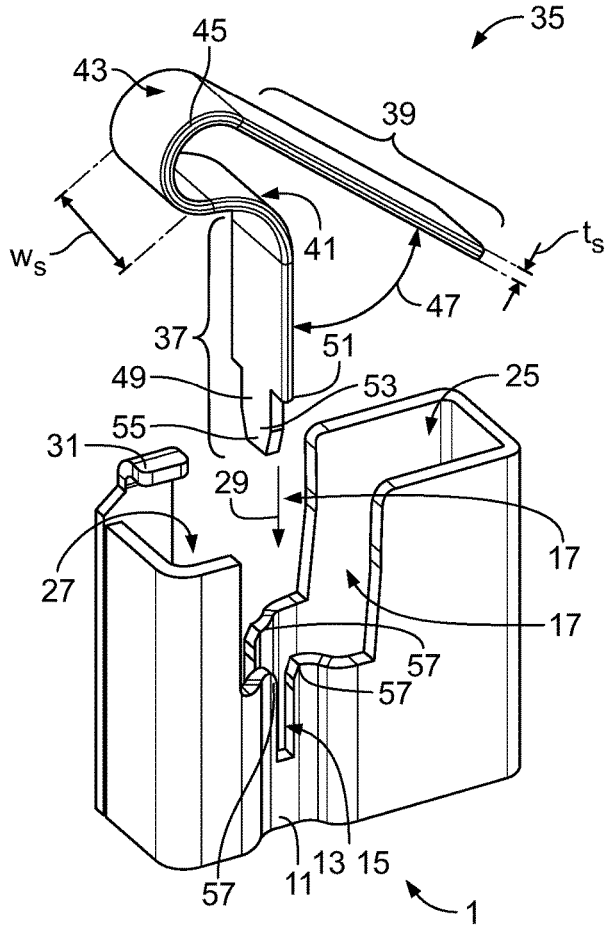
FIG. 2 is a perspective view of the insertion of a first embodiment of a spring member into the FIG. 1 push-in clamp retainer.

FIG. 2 illustrates the assembly of a first embodiment of a spring member 35 to the first embodiment of the push-in clamp retainer 1. The spring member 35 comprises a first end 37 and a second end 39, as well as a first bend region 41, and a second bend region 43. The second bend region 43 is embodied as a loop 45. The first end of the spring member 37 and the second end of the spring member 39 span an angle 47 smaller than 90° in this embodiment.

The spring member 35 has a width ws and a thickness ts. These two spring member parameters and the shape of the spring member 35 determine the spring constant. The width of the spring member ws is constant along the second end of the spring member 39, the loop 45, and the first bend region 41 and partly constant along the first end of the spring member 37.

The distal end 49 of the first end of the spring member 37 comprises a step 51 in the spring width ws, as well as a first spring tongue region 53, and a second spring tongue region 55. The first spring tongue region 53 features parallel edges, whereas the second spring tongue region is chamfered. During assembly of the spring member 35 to the push-in clamp retainer 1, the first end of the spring member 37 is oriented along the insertion direction 29. The width of the spring member ws extends perpendicular to the slits 15 located in the contractions 11.

The edges of the slits 15 each have two beveled corners 57 at the slit ends pointing towards the two recesses 17. These beveled corners 57 facilitate insertion of the spring member 35 into the receiving members 13 embodied as slits 15.

The edges of the slits 15 each have two beveled corners 57 at the slit ends pointing towards the two recesses 17. These beveled corners 57 facilitate insertion of the spring member 35 into the receiving members 13 embodied as slits 15.

The edges of the slits 15 each have two beveled corners 57 at the slit ends pointing towards the two recesses 17. These beveled corners 57 facilitate insertion of the spring member 35 into the receiving members 13 embodied as slits 15. The figures show that the second end of the spring member 39 reaches into the lead-in receptacle 25 without touching the inner wall 61. The width of the spring member ws is therefore smaller than the inner width of the push-in clamp retainer wi which is in turn smaller than the width w of the push-in clamp retainer 1.

Figure 3:
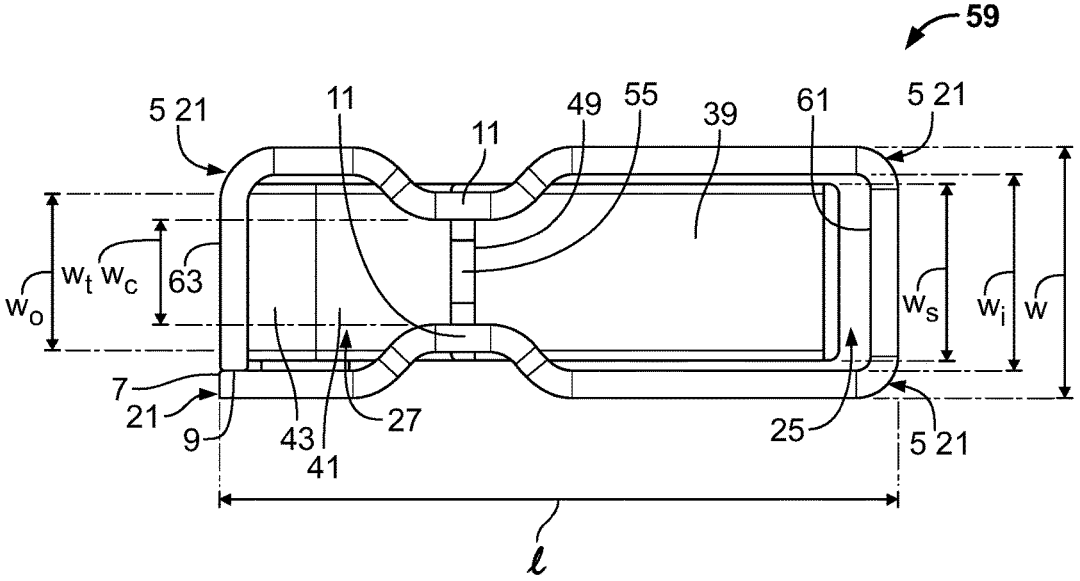
FIG. 3 is a bottom view of a first embodiment of a push-in clamp assembly.

FIG. 3 shows that the width wt of the distal end 49 of the spring member 35 is essentially equal or slightly larger than the width we between the contractions 11. Therefore, the outer edges of the first spring tongue region 53 are closely fitted to the inner wall 61 of the contractions 11.

Figure 4:
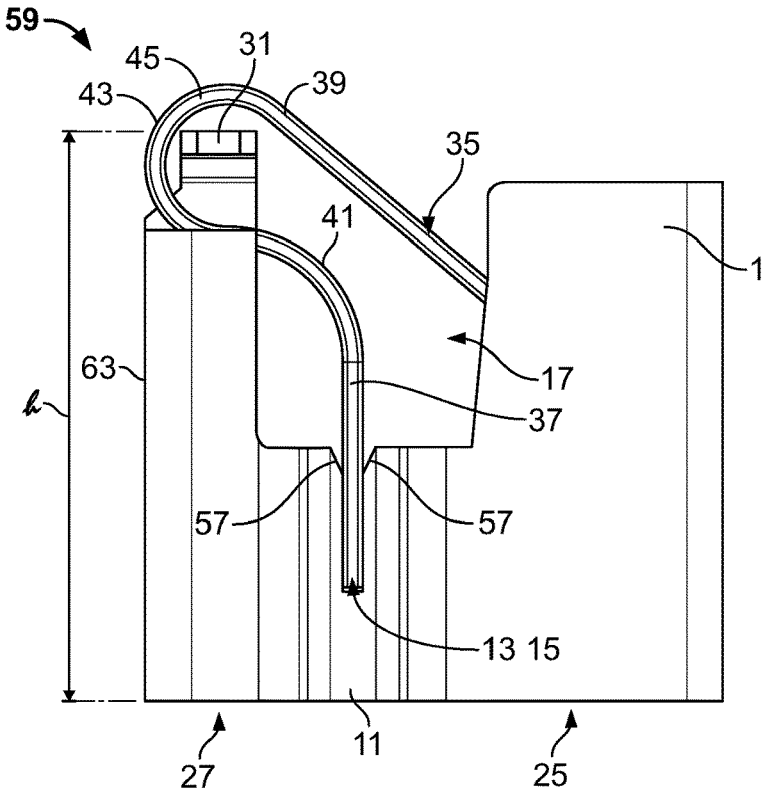
FIG. 4 is a side view of the FIG. 3 push-in clamp assembly.
Figure 5:
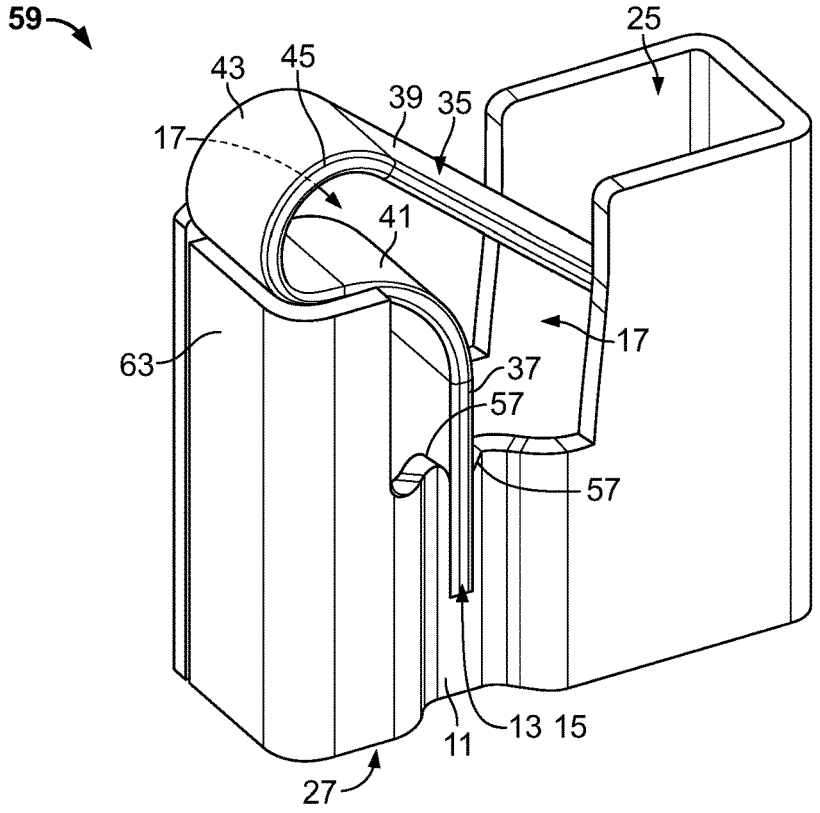
FIG. 5 is a perspective view of the FIGS. 3 and 4 push-in clamp assembly.

Furthermore, FIG. 3 shows that the first bend region 41 and the loop 45 of the spring member 35 partly cover the upper region of the rear hollow space 27 and that the loop 45 of the spring member 35 touches the upper edge 19 of the side wall 63 which is located in the proximity of the first edge of the sheet metal 7 and the second edge of the sheet metal 9. FIGS. 3 to 5 furthermore illustrate that the first end 37 of the spring member 35 as well as the first bend region 41 are partly located inside the two recesses 17, whereas the width ws of the spring member 35 is larger than the outer width wo of the two contractions 11.

The tongue 31, extending from the push-in clamp retainer 1 and bent towards the rear hollow space 27, extends into the loop 45 of the spring member 35 without extending through the loop 45 along the entire width ws of the spring member 35. Especially FIG. 5 illustrates that the spring member 35 is partly located in the contractions 11, the recesses 17, and the rear hollow space 27 and finally extends into the lead wire receptacle 25. The spring member 35 furthermore protrudes out of the push-in clamp retainer 1 above the tongue 31, and is consequently not completely encircled by the push-in clamp retainer 1. The extension of the spring member 35 away from the push-in clamp retainer 1 occurs only above the push-in clamp retainer 1, whereas the loop 45 of the spring member 35 falls in line with the side wall 63 as apparent from FIGS. 3 and 4.

Figure 6:
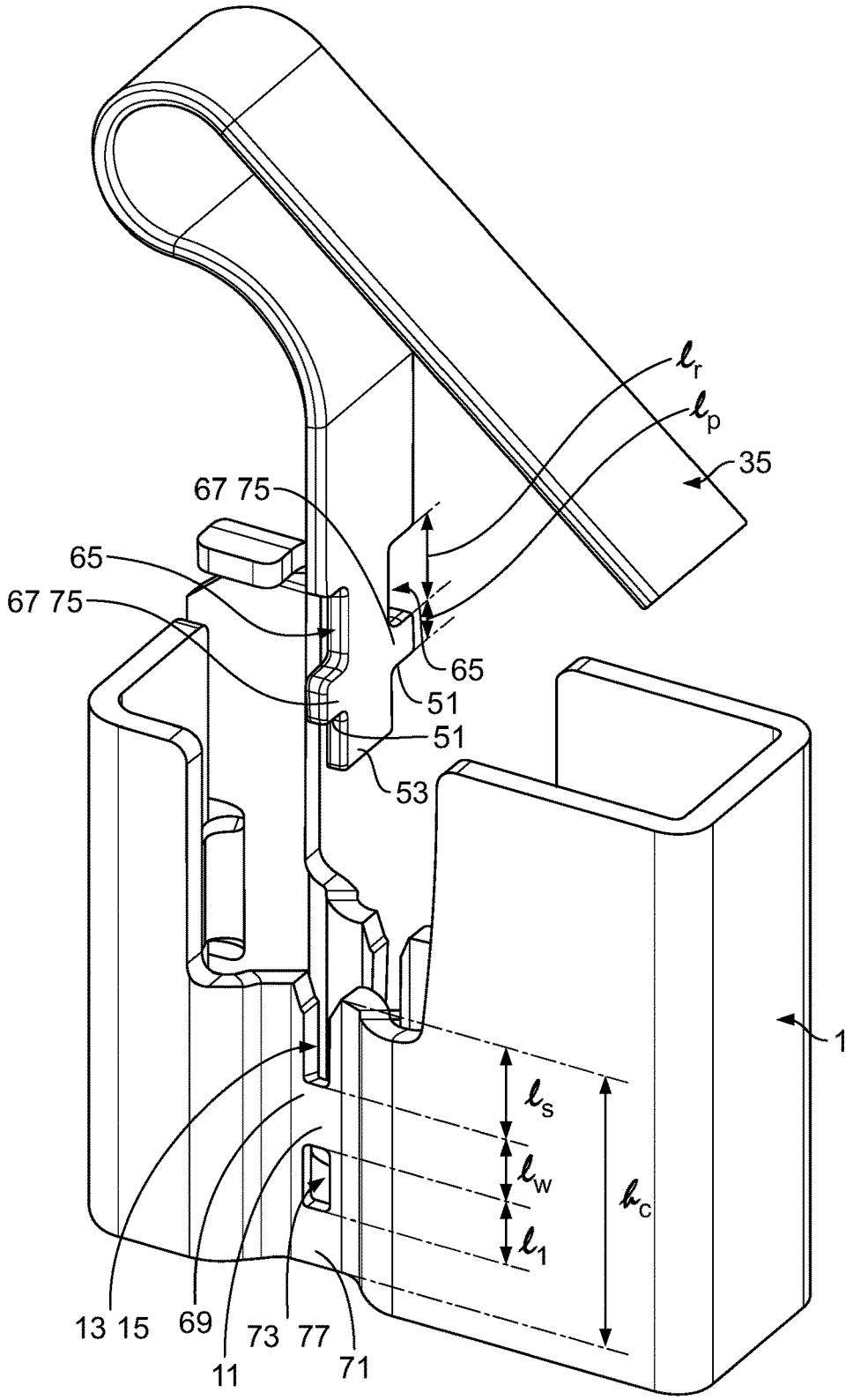
FIG. 6 is a second embodiment of a spring member being installed into a second embodiment of a push-in clamp retainer.

FIG. 6 illustrates the assembly of a second embodiment of the spring member 35 to a second embodiment of the push-in clamp retainer 1, both comprising basically the same parts as their first embodiments. Additional parts and/or functionalities are described in the following.

The second embodiment of the spring member 35 comprises two spring recesses 65 located at the first end of the spring member 37. The spring member 35 also comprises the step 51 and the first spring tongue region 53, but is designed without the chamfered second spring tongue region 55. The arrangement of the two spring recesses 65, the step 51, as well as the first spring tongue region 53, thus form two protrusions 67 having a basically rectangular shape. The spring recesses 65 have a length lr and the protrusions 67 each have the length lp.

The contractions 11 still comprise two receiving members 13 embodied as slits 15, whereas the length of the slits ls is smaller than half the height of the contraction hc. Aside from the slits 15, the contractions 11 of the second embodiment of the push-in clamp retainer 1 comprise a first partition wall 69, a second partition wall 71, and an opening 73 which is basically rectangular-shaped and located between the first partition wall 69 and the second partition wall 71. The first partition wall 69 has the length lw and the opening 73 has the length 11.

The second embodiments of the spring member 35 and the push-in clamp retainer 1 are designed such that the lengths of the spring recesses lr are equal to or slightly larger than the length of the first partition wall lw and such that the lengths of the protrusions 1*p* are equal to or slightly smaller than the length of the openings 11. During assembly and in the assembled state, the protrusions 67 are counter-locking members 75 that may be locked to the openings 73 being locking members 77.

Figure 7:
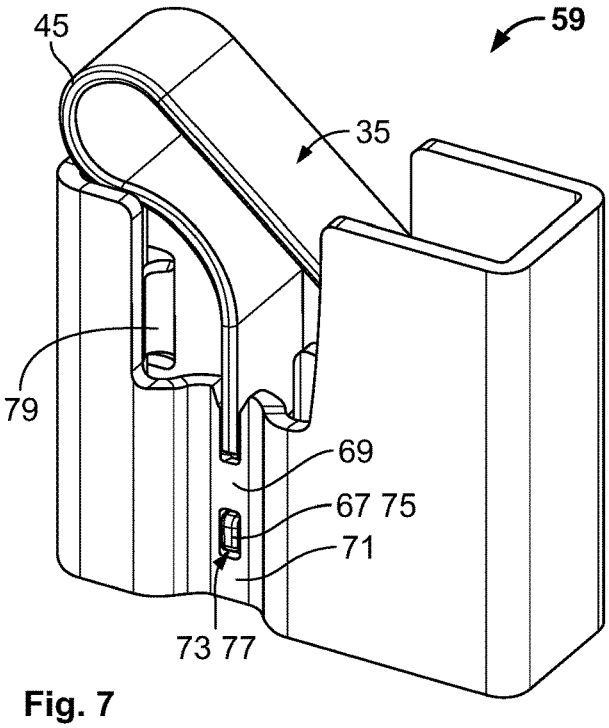
FIG. 7 is a perspective view of a second embodiment of a push-in clamp assembly.
Figure 8:
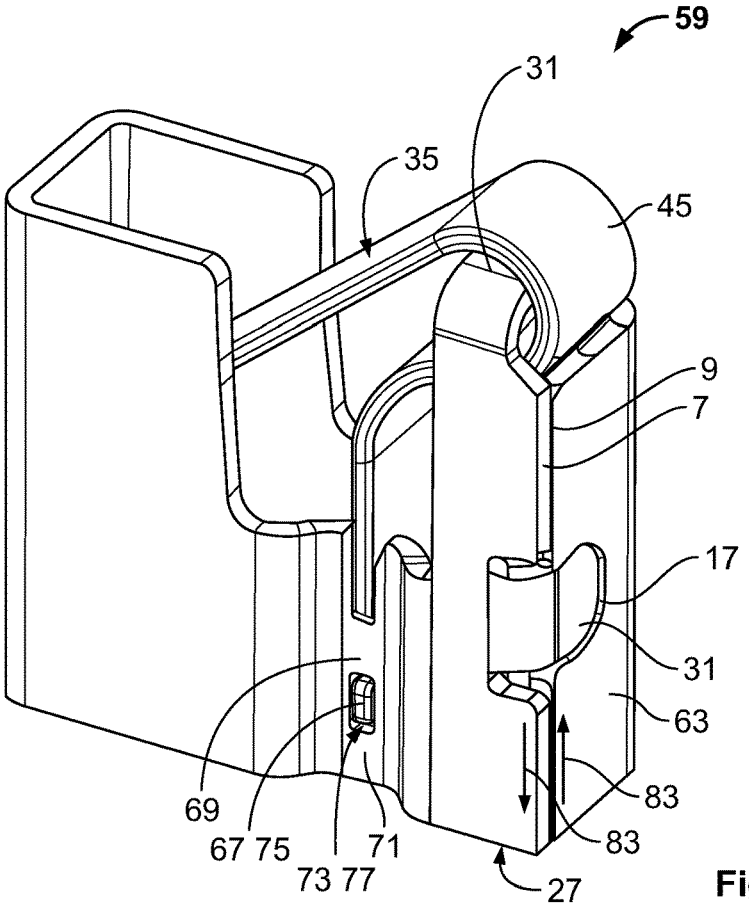
FIG. 8 is a different perspective view of the push-in clamp assembly of FIG. 7.

FIGS. 7 and 8 are different perspective views of a second embodiment of the push-in clamp assembly 59 comprised of the second embodiment of the spring member 35 and the second embodiment of the push-in clamp retainer 1. These figures show that the two protrusions 67 of the spring member 35 are located and/or snapped into the two openings 73 of the two contractions 11. Assembled in such a way, the spring member 35 may not fall out of the push-in clamp retainer 1 when held with the loop 45 of the spring member 35 directing downwards. The spring member 35, however, is additionally secured against falling out of the push-in clamp retainer 1 by the tongue 31 extending into the loop 45. Furthermore, FIG. 7 and FIG. 8 show that the first edge of the sheet metal 7 is engaged to the second edge of the sheet metal 9 by means of a bent tongue 31 extending away from the first edge of the sheet metal 7, bent towards the rear hollow space 27, and inserted into a recess 17 located in the side wall 63. This positive locking of the tongue 31 and the recess 17 in the side wall 63 prevents a shearing motion of the first edge of the sheet metal 7 against the second edge of the sheet metal 9 with the shearing motion being indicated by the arrows 83.

Figure 9:
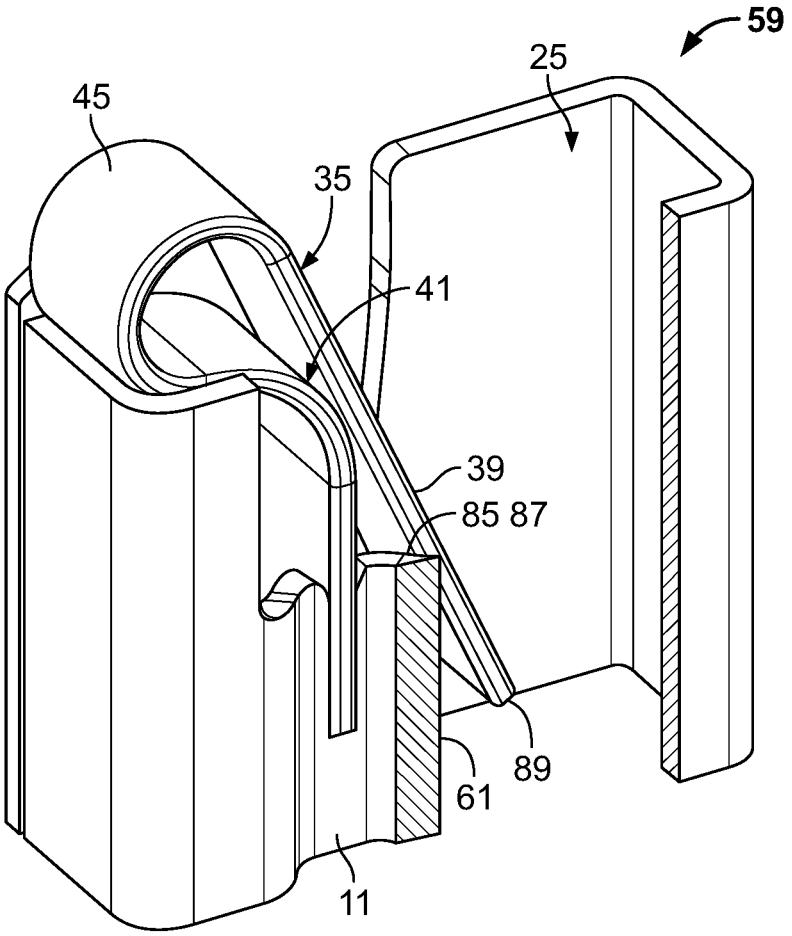
FIG. 9 is a perspective view of the FIGS. 3, 4, and 5 push-in clamp assembly with the lead wire receptacle partially cutaway.

FIG. 9 is a perspective and partially cut-away view of the push-in clamp assembly 59 in the first embodiment while the spring member 35 is in a compressed state. The element responsible for the compression of the spring member 35, for instance a lead wire 119, is not shown for clarity. The cutaway in the push-in clamp retainer wall allows insight into the lead wire receptacle 25 and shows the second end of the spring member 39 which is deflected such that it contacts the inner wall 61 of the contraction 11 in a contact point 85. The opposite lying second contraction 11 is embodied symmetrically and therefore the second end of the spring member 39 also touches the opposing lying contraction 11 in a second contact point 85 (not shown in the figure).

As the second end of the spring member 39 touches the inner wall 61 at two contact points 85 located at the two contractions 11, further deflection of the second end of the spring member 39 is prevented as the two contractions 11 act as stoppers 87. As the second end of the spring member 39 touches the push-in clamp retainer 1 at the two points, the deflective movement of the second end of the spring member 39 is stopped at the two stoppers 87.

However, with sufficient force exerted on the end face of the spring member 89, a minor deflection of the second end of the spring member 39 may still be possible. However, before the second end of the spring member 39 touches the two stoppers 87, the entire length of the second end of the spring member 39, that is from the end face of the spring member 89 to the beginning of the loop 45, acts as an arm of a lever for compression of the loop 45. Once the second end of the spring member 39 touches the stoppers 87, the stoppers are the fulcrum of a lever. The second end of the spring member 39 hence comprises a short lever arm from the contact points 85 to the end face of the spring member 89 and a longer lever arm from the contact points 85 to the beginning of the loop 45. Deflection of the small lever arm initiates a movement of the long lever arm around the line between the contact points 85, whereas the exerted force initiates a decreasing bend of the first bend region 41. Due to the relationship of the levers, the force needed to further deflect the second end of the spring member 39 away from the lead wire receptacle 25 after touching the stoppers 87 is higher than the force needed to deflect the second end of the spring member 39 until it contacts the stoppers 87.

Figure 10:
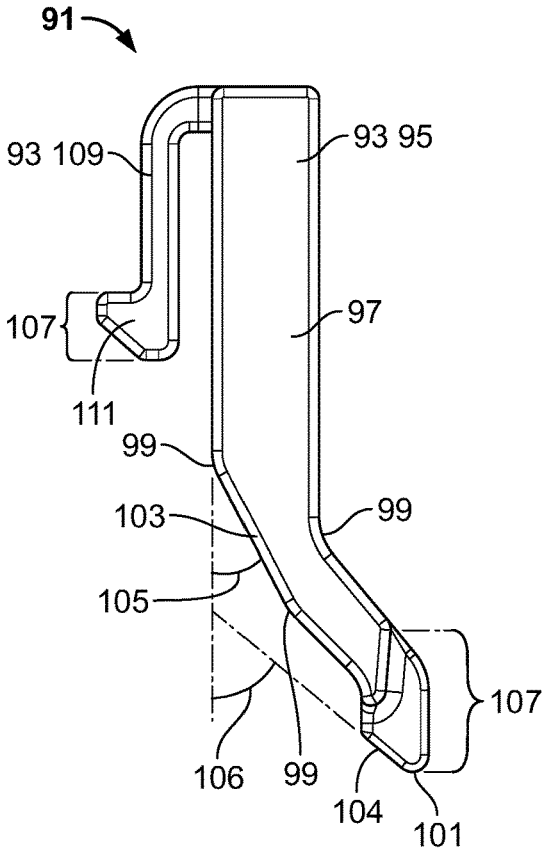
FIG. 10 is a side view of a first embodiment of a spring release member.
Figure 11:
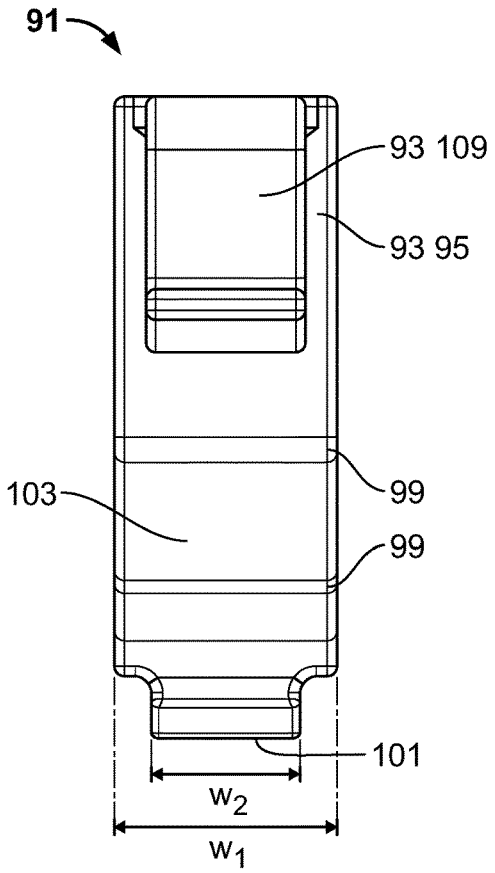
FIG. 11 is a front view of the FIG. 10 spring release member.
Figure 12:
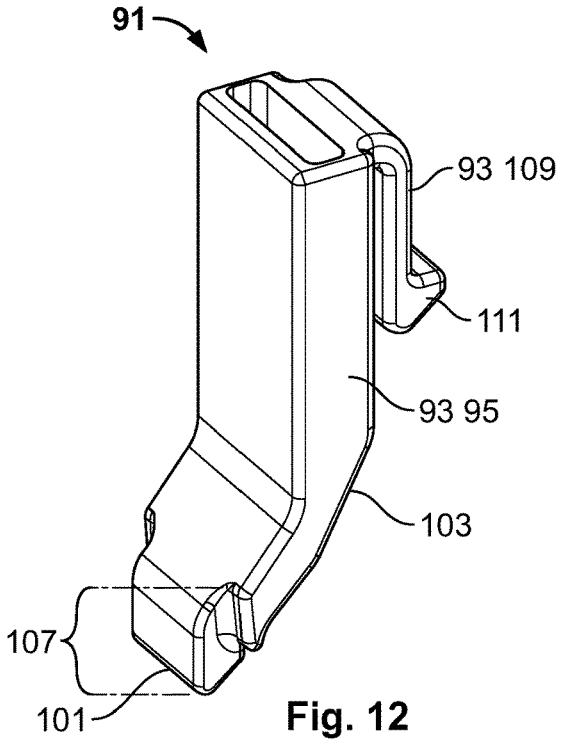
FIG. 12 is a perspective view of the FIGS. 10 and 11 spring release member.

FIGS. 10 to 12 illustrate different views of a spring release member 91 comprising two arms 93 that are partly parallel to each other. The spring release arm 95 comprises a hollow body 97 that merges at different bend points 99 into a tip 101. The bend points 99 of the hollow body 97 are arranged such that a rear surface 103 of the spring release arm 95 is bent away from the other arm 93 of the spring release member 91 spanning an angle 105. A tip region 107 of the spring release arm 95 further comprises a second rear surface 104 which spans a second angle 106 with the hollow body 97. The spring release arm 95 has the width w1, except in the tip region 107 where the width is decreased to w2.

The second arm 93 of the spring release member 91 is a locking sub-assembly 109 with the same width w2 as the tip region 107 but a smaller length as compared to the spring release arm 95. In the tip region 107 of the locking sub-assembly, a detent hook 111 is formed which points away from the spring release arm 95. In contrast to the spring release arm 95, the locking sub-assembly is not constructed hollow but is compact and is consequently flexible with respect to the spring release arm 95.

Figure 13:
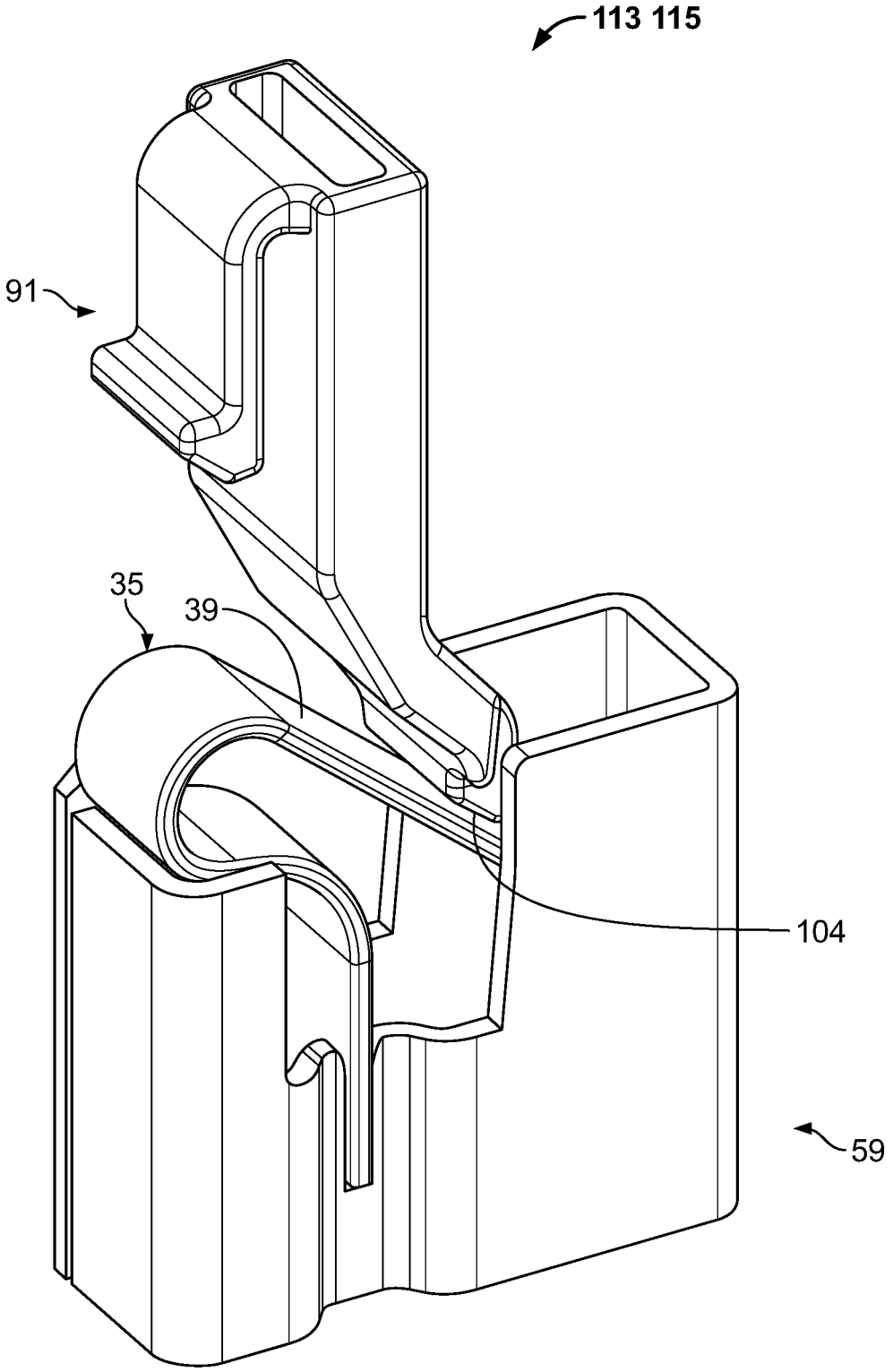
FIG. 13 is a perspective view of the FIGS. 3, 4, and 5 push-in clamp assembly and the FIGS. 10, 11, and 12 spring release member.

FIG. 13 illustrates an electric connector element 113 comprising the spring release member 91 and the push-in clamp assembly 59. The electric connector element 113 is shown in an idle state 115 with the second rear surface 104 touching the second end of the spring member 39 over a large area that is the second angle 106 of the second rear surface 104 is equal to the inclination of the second end of the spring member 39.

Figure 14:
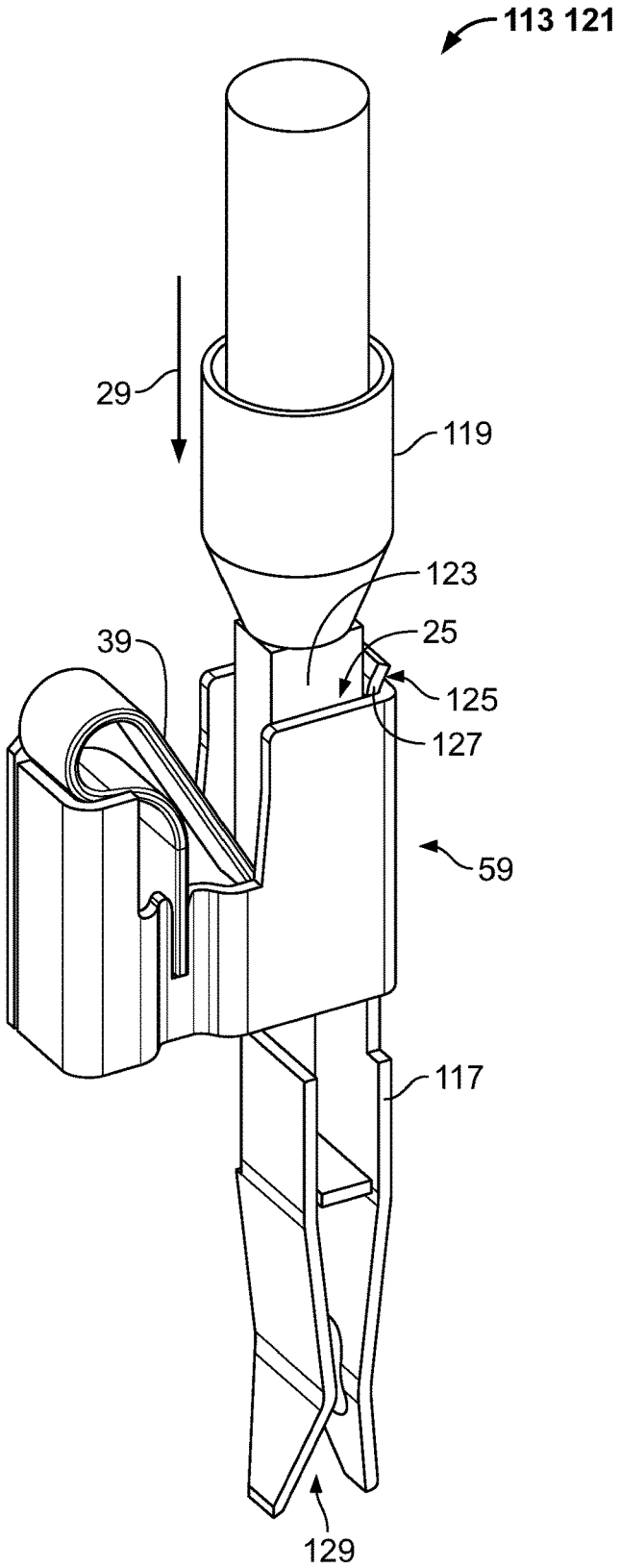
FIG. 14 is a perspective view of the FIGS. 3, 4, and 5 push-in clamp assembly with an inserted lead wire and an inserted second clamp connector.

FIG. 14 illustrates the electric connector element 113 comprising another clamp connector 117, a lead wire 119, and the push-in clamp assembly 59. The electric connector element 113 is in an operating state 121. More specifically, the second end of the spring member 39 is deflected away out of the lead wire receptacle 25 and subsequently released such that the second end of the spring member 39 presses the end of the lead wire 123 against an electrically conducting element 125 of the clamp connector 117. The clamp connector 117 is inserted into the lead wire receptacle 25 in a direction opposite to the insertion direction 29 and is secured in the lead wire receptacle 25 by means of a clamp connector bend 127. The clamp connector 117 comprises a second receptacle 129 for receiving a second lead wire (not shown) for electrically connecting the second lead wire to the first lead wire 119.

In the embodiment shown in FIG. 14, the cable direction of the lead wire 119 is not altered. More specifically, the second lead wire (not shown) which is to be inserted into the second receptacle 129 is oriented parallel to the first lead wire 119. Deflection of the second lead wire (not shown) depends solely on the construction of the second clamp connector 117.

Figure 17:
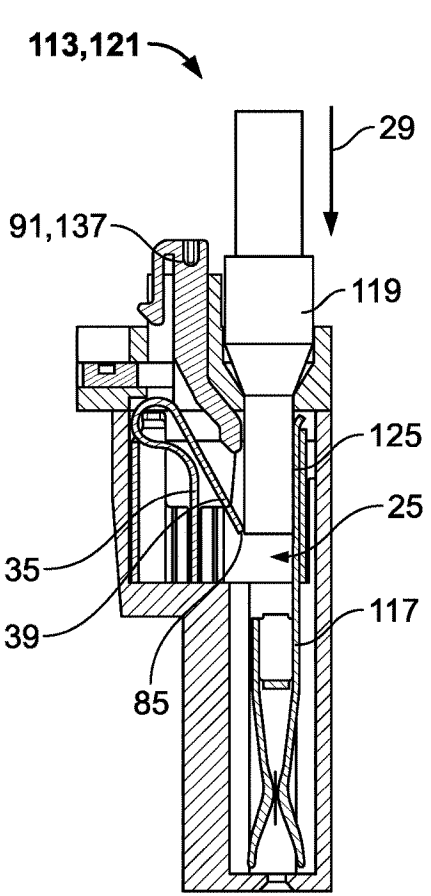
FIG. 17 is a sectional view of the FIGS. 15 and 16 electric connector element in an operating state.
Figure 16:
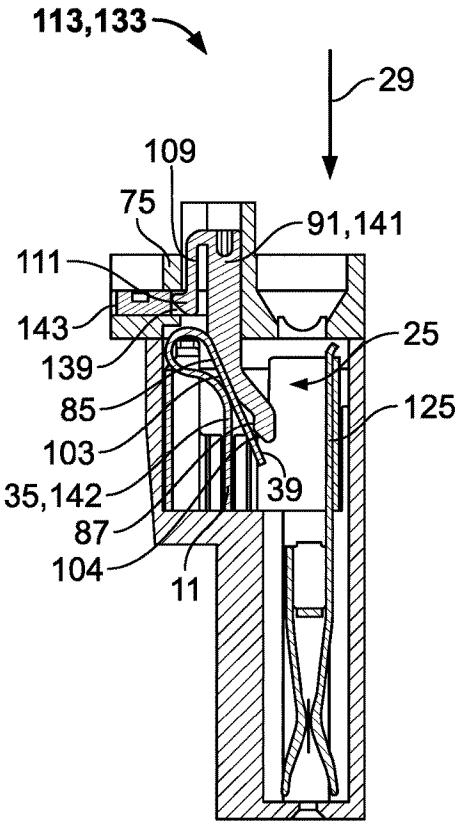
FIG. 16 is a sectional view of the FIG. 15 electric connector element in an assembly state.
Figure 15:
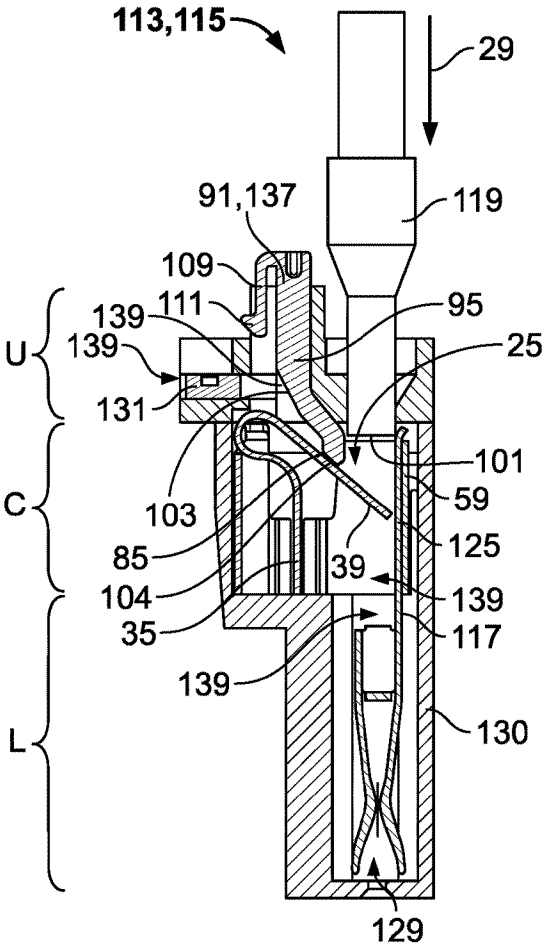
FIG. 15 is a sectional side view of a first embodiment of an electric connector element in an idle state.

Referring to FIGS. 15-17, the electric connector element 113 comprises the lead wire 119, a connector housing 130, the spring release member 91, an unlatching member 131, the push-in clamp assembly 59 as well as the second clamp connector 117. The connector housing 130 comprises different recesses 17 for insertion of the second clamp connector 117 in a lower part L, the push-in clamp assembly 59 in a center part C, and the spring release member 91 and the unlatching member 131 in an upper part U. Several parts of the electric connector element 113 may extend over two parts of the electric connector element, such as, for instance, the electrically conducting element 125 that extends into the center part C.

FIG. 15 shows the electric connector element 113 in the idle state 115; FIG. 16 shows the electric connector element 113 in an assembly state 133; and FIG. 17 shows the electric connector element 113 in the operating state 121.

In FIG. 15, the lead wire 119 is about to be connected to the electric connector element 113. The spring release member 91 is in an operating position 137. More specifically, the second rear surface 104 of the spring release arm 95 hinges to the second end of the spring member 39.

The spring release member 91 is inserted into a housing receptacle 139 such that the housing receptacle walls prevent the spring release member 91 from being disassembled from the electric connector element 113.

In the idle state 115 of the electric connector element 113, the second end of the spring member 39 extends into the lead wire receptacle 25 with the end face of the spring member 89 being located in proximity of the electrically conducting element 125. The unlatching member 131 is a movable cuboid part located in a second housing receptacle 139. The movement of the unlatching member 131 is guided by this second housing receptacle 139.

In FIG. 16, the electric connector element 113 is shown in the assembly state 133. More specifically, the spring release member 91 is in an assembly position 141. To reach this assembly position 141, the spring release member 91 is moved along the insertion direction 29, whereas during this linear movement of the spring release member 91, the second end of the spring member 39 is deflected away from the lead wire receptacle 25 and approaches the contractions 11 as well as the stoppers 87.

During the increasing inclination of the second end of the spring member 39, the contact point 85 between the spring release member 91 and the second end of the spring member 39 changes from the second rear surface 104 to the first rear surface 103 of the spring release member 91. Due to the changed position of the contact point 85 between the spring release member 91 and the second end of the spring member 39, the length of the lever deflecting the second end of the spring member 39 decreases leading to an increased force necessary for deflection. This fact results in a haptic feedback indicating that the assembly position is approached by a stronger force to be applied to the spring release member 91. During the movement of the spring release member 91 in the insertion direction 29, the detent hook 111 of the locking sub-assembly 109 touches the counter-locking member 75 deflecting the locking sub-assembly 109 towards the hollow body 97 of the spring release member 91 such that the detent hook 111 of the locking sub-assembly 109 is moved sideways along the counter-locking member 75 until the assembly position 141 of the spring release member 91 is reached.

In the assembly position 141, the detent hook 111 reaches the housing receptacle 139 in which the unlatching member 131 is located as well and the detent hook 111 consequently engages in a positive lock with the counter-locking member 75, preventing the spring release member 91 from being moved opposite to the insertion direction 29. Consequently, in the assembly state 133 of the electric connector element 113, the spring release member 91 is locked in an assembly position 141 by positive locking of the detent hook 111 with the counter-locking member 75 and the second end of the spring member 39 is deflected away and out of the lead wire receptacle 25 and held in a pre-tension position 142.

In the assembly state 133, a lead wire (not shown in FIG. 16) may be inserted into the lead wire receptacle 25 without any additional force necessary. In the assembly position of the spring release member 91, the unlatching member 131 and especially the trigger surface 143 do not extend over the edges of the connector housing 130. By this means, the connector housing prevents an accidental unlocking of the detent hook 111 and the counter-locking member 75 as well as an accidental release of the second end of the spring member 39 into the lead wire receptacle 25. After a lead wire (not shown) is inserted into the lead wire receptacle 25, a trigger surface 143 is operated to move the unlatching member 131 into a direction towards the lead wire receptacle 25. The unlatching member 131 touches the detent hook 111 and deflects the locking sub-assembly 109 such that the positive lock between the detent hook 111 and the counter-locking member 75 is released. Releasing this positive lock results in a movement of the spring release member 91 in a direction opposite to the insertion direction 29. The movement is initiated by the spring member 35. The spring release member 91 thus moves back into the operating position 137 which is shown in FIG. 17.

In the operating state 121 of the electric connector element 113, the spring member 35 exerts a spring force to the lead wire 119 which is inserted into the lead wire receptacle 25 and pressed against an electrically conducting element 125 of the second clamp connector 117. The lead wire 119 is secured against accidental removal out of the lead wire receptacle 25 by means of the inclination of the second end of the spring member 39 as the lead wire 119 gets stuck at the contact point 85 when moved opposite to the insertion direction 29, that is out of the lead wire receptacle 25.

Figure 18:
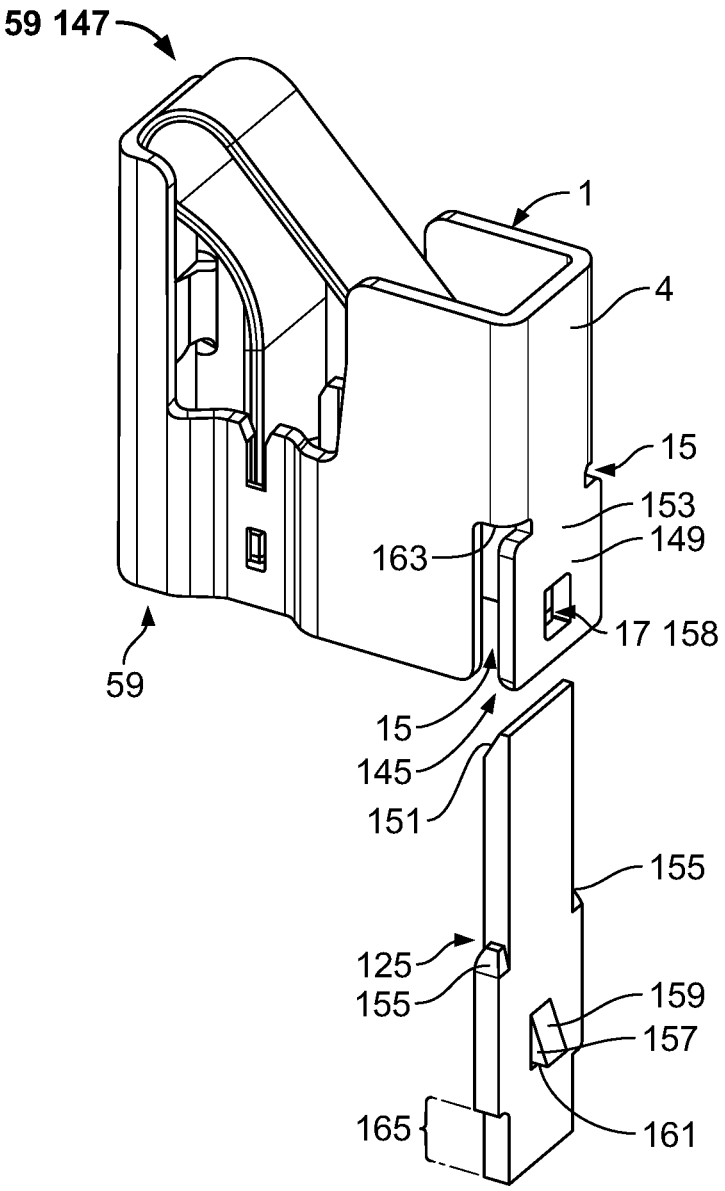
FIG. 18 is perspective view of a the FIGS. 7, 8, and 9 push-in clamp assembly and a first embodiment of an electrically conductive element.

FIG. 18 shows the FIGS. 7-9 push-in clamp assembly 59 and a first embodiment of an electrically conducting element 125. The push-in clamp assembly 59 comprises two slits 15 and a latch 149 embodied in the surrounding wall 4 of the push-in clamp retainer 1. The latch 149 comprises a recess 17 and a chamfer 151. The recess 17 represents the counter latching element 158. The chamfer 151 is tilted towards a further receptacle 145 comprising the slits 15, the latch 149 as well as parts of the inner surrounding wall 4. In order to increase the flexibility of the latch 149, the monolithic contact to the surrounding wall 4 shows a flexibility increasing area 153. The electrically conducting element 125 comprises a chamfer 151, two shoulders 155, a locking element 157 and a contact area 159. The locking element 157 comprises a tilted surface 159 and a steep surface 161.

Figure 19:
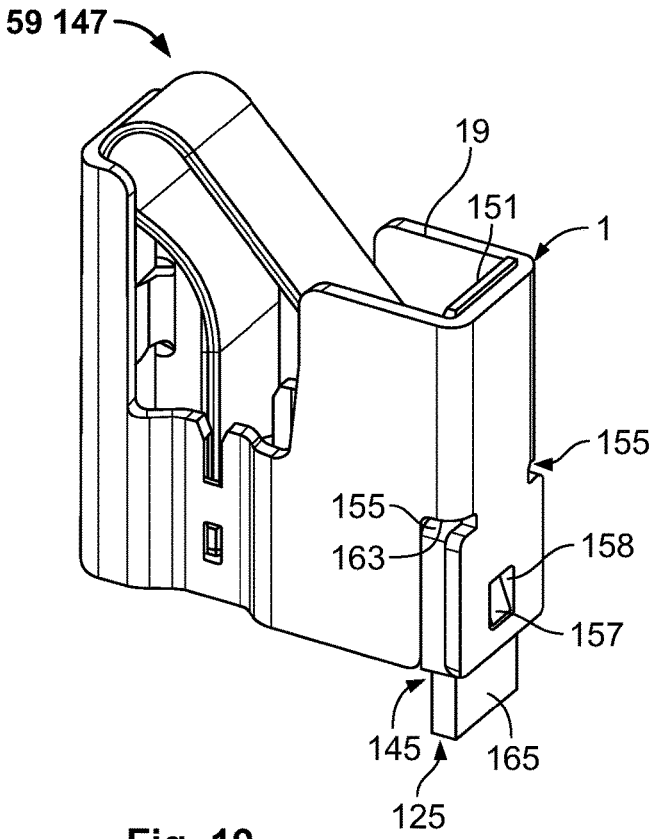
FIG. 19 is a perspective view of the FIGS. 7, 8, and 9 push-in clamp assembly and the FIG. 18 electrically conductive element installed.

In FIG. 19, the electrically conducting element 125 is inserted into the further receptacle 145 of the push-in clamp assembly 59. The locking element 157 is engaged with the counter locking element 158 and the shoulders 155 of the electrically conducting element 125 abut at the end of the slits 163, thus blocking a further insertion of the electrically conducting element 125 into the further receptacle 145. The electrical contact member 165 is the only part of the electrically conducting element 125 which extends out of the push-in clamp assembly 59. The chamfer 151 of the electrically conducting element 125 is flush with the upper edge 19 of the push-in clamp retainer 1.

Figure 20:
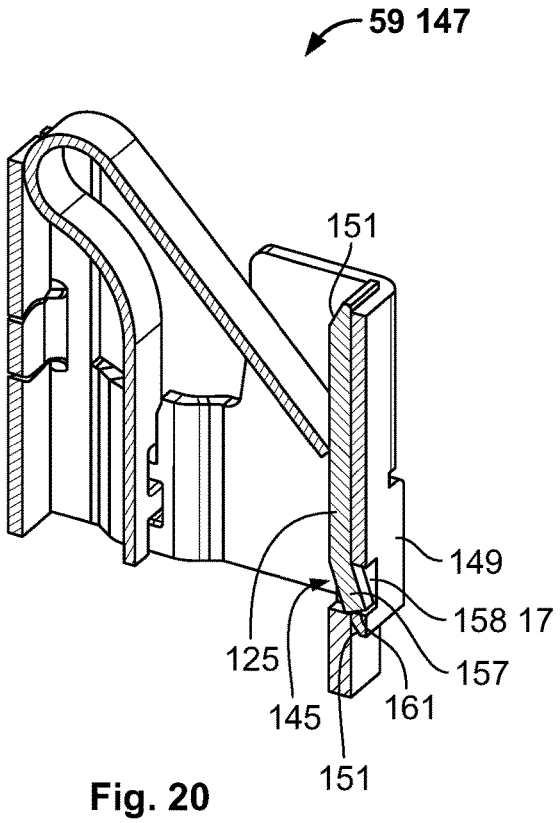
FIG. 20 is sectional perspective view of the FIG. 19 push-in clamp assembly.

In FIG. 20, the push-in clamp with inserted electrically conducting element 125 is shown in a cutaway perspective view and illustrates the chamfer 151 embodied at the electrically conducting element 125 and at the latch 149 of the further receptacle 145. FIG. 20 furthermore shows how the locking element 157 is retained and fixed inside the counter locking element 158 by means of the steep surface 161 of the locking element 157 abutting the inside of the counter locking element 158 embodied as a recess 17.

Figure 21:
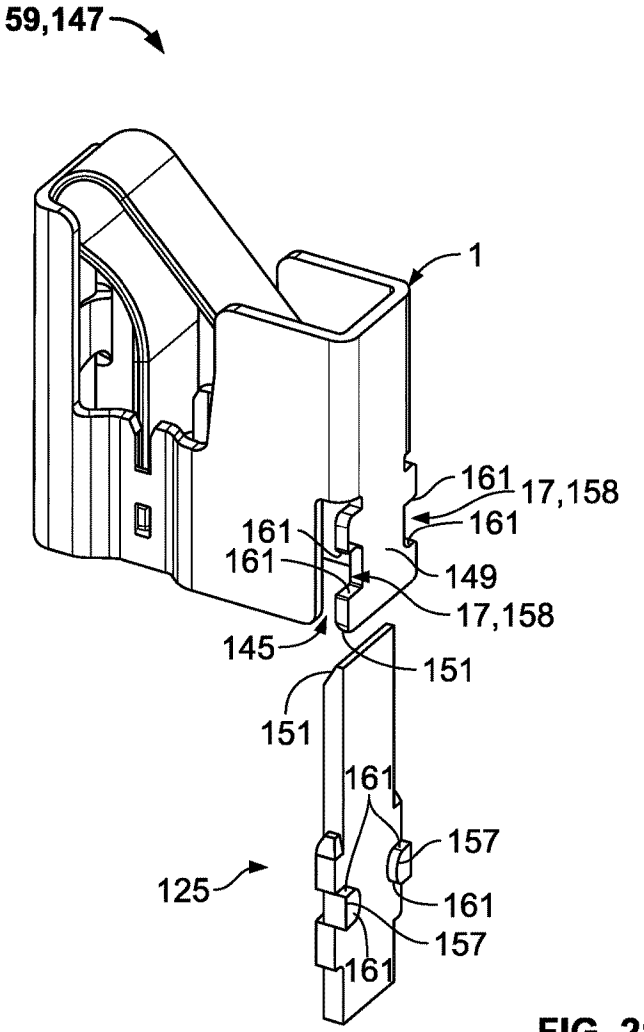
FIG. 21 is a perspective view of a third embodiment of a push-in clamp assembly with a second embodiment of an electrically conductive element.

FIG. 21 shows a third embodiment of the push-in clamp assembly 59 with a second embodiment of the electrically conducting element 125. This embodiment of the push-in clamp assembly 59 also comprises a latch 149, with the latch 149 comprising two recesses 17 acting as counter locking elements 158. The counter locking elements 158 are positioned at the edges of the latch 149 and are only partially surrounded by the material of the latch 149.

The electrically conducting element 125 comprises two locking elements 157 embodied as two extrusions with a base area formed as a semicircle. The embodiments of the push-in clamp assembly 59 and the electrically conducting element 125 shown in FIG. 21 comprise a chamfer 151. The chamfer 151 located at the latch 149 facilitates insertion of the electrically conducting element 125 into the further receptacle 145, while the chamfer 151 located at the electrically conducting element 125 facilitates insertion of a lead wire 119 (not shown) into the lead wire receptacle 25. The latching elements 157, as well as the counter latching elements 158, are each positioned at the edges of the electrically conducting element 125 or the latch 149, respectively. Upon insertion of the electrically conducting element 125 into the further receptacle 145, the locking elements 157 interact with the chamfer 151 of the latch 149, deflecting the latch 149 away from the push-in clamp retainer 1, finally snapping into the counter locking elements 158. The locking elements 157 and the counter locking elements 158 show steep surfaces 161 that engage the positive lock between the electrically conducting element 125 and the push-in clamp assembly 59.

Figure 22:
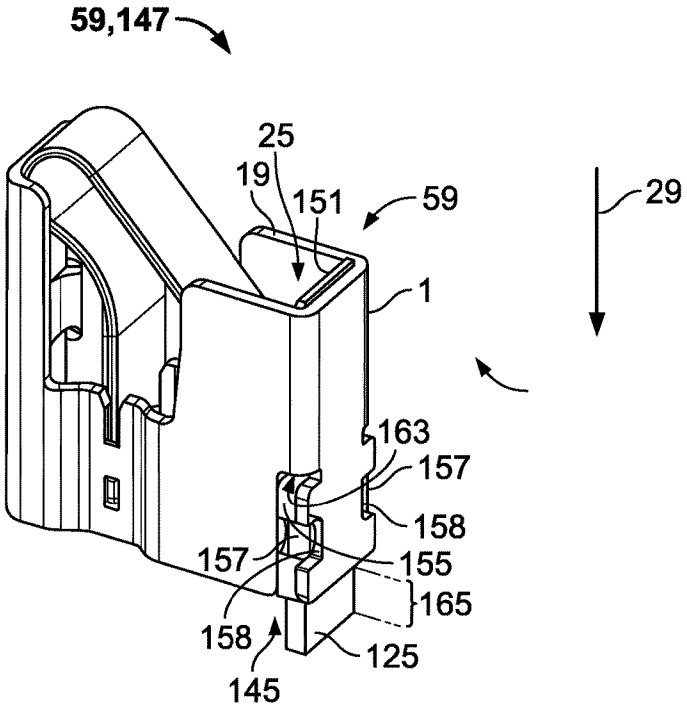
FIG. 22 is a perspective view of the FIG. 21 push-in clamp assembly with the FIG. 21 electrically conductive element installed.

FIG. 22 shows the engaged state between the push-in clamp assembly 59 and the electrically conducting element 125. The electrically conducting element 125 is inserted into the further receptacle 145 and by means of the positive engagement between the locking elements 157 and the counter locking elements 158, a movement of the electrically conducting element 125 in or against the insertion direction 29 is blocked. Furthermore, the shoulders 155 of the electrically conducting element 125 touch the end of the slit 163 also blocking further movement of the electrically conducting element 125 against the insertion direction 29. The chamfer 151 of the electrically conducting element 125 is flush with the upper edge 19 of the push-in clamp retainer 1 and the electrical contact member 165 extends in the insertion direction 29 out of the push-in clamp retainer 1. The electrically conducting element 125 is tightly retained in the further receptacle 145 and partially lines the lead wire receptacle 25. By retaining the electrically conducting element 125 in such a way, translation and rotation of the electrically conducting element 125 with respect to the push-in clamp assembly 59 is minimized for all 6 degrees of freedom.

The foregoing illustrates some of the possibilities for practicing the invention. Other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A push-in clamp retainer comprising:

a surrounding wall in a lateral direction that forms at least one lateral contraction of the push-in clamp retainer at which opposite sides of the surrounding wall are positioned closer to one another, the at least one lateral contraction having a receiving member formed as a slit extending through the surrounding wall, at least one recess in the surrounding wall extending from the least one lateral contraction to an upper edge of the surrounding wall and communicating with the slit; and a spring member fixed to the receiving member of the surrounding wall and secured in the slit.

2. A push-in clamp retainer according to claim 1, wherein the surrounding wall has two lateral contractions and each lateral contraction has the receiving member.

3. A push-in clamp retainer according to claim 1, wherein the push-in clamp retainer is a monolithically stamped and bent sheet metal part having two opposing edges engaged to one another by a positive lock.

4. A push-in clamp retainer according to claim 3, wherein the surrounding wall at least partially encircles a lead wire receptacle.

5. A push-in clamp assembly comprising:

a push-in clamp retainer comprising a surrounding wall in a lateral direction at least partially encircling a lead wire receptacle, forming at least one lateral contraction of the push-in clamp retainer at which opposite sides of the surrounding wall are positioned closer to one another, the at least one lateral contraction having a receiving member and separating the lead wire receptacle from a rear hollow space also partly encircled by the surrounding wall in the lateral direction, at least one recess in the surrounding wall extending from the at least one lateral contraction to an upper edge of the surrounding wall and communicating with the receiving member; and a spring member fixed to the receiving member of the surrounding wall, the spring member having a first end attached to the push-in clamp retainer at the at least one lateral contraction and a second free end extending elastically displaceable into the lead wire receptacle, the at least one lateral contraction receiving the spring member is a stopper for delimiting a deflection of the second free end of the spring member away from the lead wire receptacle, the spring member extending at least partly into the rear hollow space.

6. A push-in clamp assembly according to claim 5, wherein the spring member has a bent section which extends over more than 270°.

7. A push-in clamp assembly according to claim 6, wherein the spring member extends at least partly into the recess.

8. A push-in clamp assembly according to claim 7, wherein the spring member has at least one bend region such that the first end of the spring member and the second end of the spring member span an angle smaller than 90°.

9. A push-in clamp assembly according to claim 8, wherein the spring member has a loop and the push-in clamp retainer further includes a tongue that extends into the loop of the spring member.

10. An electric connector element comprising:

a push-in clamp retainer comprising a surrounding wall in a lateral direction that forms at least one lateral contraction of the push-in clamp retainer at which opposite sides of the surrounding wall are positioned closer to one another, the at least one lateral contraction having a receiving member, at least one recess in the surrounding wall extending from the at least one lateral contraction to an upper edge of the surrounding wall and communicating with the receiving member;

a spring member fixed to the receiving member of the surrounding wall, the spring member having a first end attached to the push-in clamp retainer in the at least one lateral contraction and a second free end extending elastically displaceable into a lead wire receptacle; and a spring release member movable from an assembly position at which the spring member is elastically deflected by the spring release member away from the lead wire receptacle, the at least one lateral contraction delimiting the deflection of the second free end of the spring member away from the lead wire receptacle, to an operating position at which the spring release member is moved away from the spring member.

11. An electric connector element according to claim 10:

(a) further including a locking sub-assembly, and (b) the spring release member is locked in the assembly position by the locking subassembly.

12. An electric connector element according to claim 11, wherein the locking sub-assembly has an unlatching member with a trigger surface manually operable from outside the electric connector element for unlocking the locking sub-assembly.

13. A push-in clamp retainer according to claim 4, wherein the lead wire receptacle has a further receptacle for retaining and fixing an electrically conducting element in the lead wire receptacle.

14. A push-in clamp retainer according to claim 1, wherein the spring member extends at least partly into the at least one recess.

15. A push-in clamp assembly according to claim 5, wherein the receiving member is formed as a slit extending through the surrounding wall.

16. An electric connector element according to claim 10, wherein the receiving member is formed as a slit extending through the surrounding wall.

* * * * *